US008251270B2

(12) United States Patent
Tseng

(10) Patent No.: US 8,251,270 B2
(45) Date of Patent: Aug. 28, 2012

(54) PLASTIC GROCERY BAG DISPENSER WITH SIDE PANELS AND GUIDE BAR

(75) Inventor: Ben Tseng, East Brunswick, NJ (US)

(73) Assignee: Inteplast Group, Ltd., Livingston, NJ (US)

( * ) Notice: Subject to any disclaimer, the term of this patent is extended or adjusted under 35 U.S.C. 154(b) by 416 days.

(21) Appl. No.: 12/586,839

(22) Filed: Sep. 29, 2009

(65) Prior Publication Data

US 2011/0073629 A1 Mar. 31, 2011

(51) Int. Cl.
*B65H 35/10* (2006.01)

(52) U.S. Cl. ..... 225/47; 225/39; 225/66

(58) Field of Classification Search ..... 225/39, 225/46, 47, 50, 51, 66, 106; 242/593
See application file for complete search history.

(56) References Cited

U.S. PATENT DOCUMENTS

| | | | | | |
|---|---|---|---|---|---|
| 293,349 | A * | 2/1884 | Newbury | 225/39 |
| 2,462,776 | A * | 2/1949 | Price | 225/33 |
| 2,586,501 | A * | 2/1952 | Baar | 225/39 |
| 5,209,371 | A * | 5/1993 | Daniels | 221/63 |
| 5,219,424 | A * | 6/1993 | Simhaee | 225/47 |
| 5,261,585 | A * | 11/1993 | Simhaee | 225/47 |
| 5,433,363 | A * | 7/1995 | Simhaee | 225/47 |
| 5,480,084 | A | 1/1996 | Daniels | |
| 5,556,019 | A * | 9/1996 | Morris | 225/96 |
| 5,558,262 | A * | 9/1996 | Simhaee | 225/106 |
| 5,573,168 | A * | 11/1996 | Kannankeril et al. | 225/106 |
| 5,706,993 | A * | 1/1998 | DeMatteis | 225/106 |
| 5,732,833 | A * | 3/1998 | Alvarado et al. | 211/59.1 |
| 5,752,666 | A * | 5/1998 | Simhaee | 242/160.4 |
| 5,813,585 | A * | 9/1998 | Kannankeril et al. | 225/106 |
| 5,934,535 | A * | 8/1999 | Kannankeril et al. | 225/106 |
| 6,135,281 | A | 10/2000 | Simhaee | |
| 6,230,953 | B1 * | 5/2001 | Simhaee | 225/46 |
| 6,279,806 | B1 * | 8/2001 | Simhaee | 225/106 |
| 6,431,396 | B1 * | 8/2002 | Daniels et al. | 221/45 |
| 6,450,380 | B1 * | 9/2002 | Simhaee | 225/46 |
| 6,685,075 | B1 * | 2/2004 | Kannankeril | 225/96 |
| 6,786,377 | B1 * | 9/2004 | Holden | 225/106 |
| 7,128,251 | B1 * | 10/2006 | Galle | 225/2 |
| 7,270,256 | B2 * | 9/2007 | Daniels | 225/93 |
| 7,273,193 | B2 * | 9/2007 | Slocum et al. | 242/593 |
| 7,424,963 | B2 * | 9/2008 | Daniels | 225/93 |
| 7,591,405 | B2 * | 9/2009 | Daniels | 225/93 |
| 2003/0098326 | A1 * | 5/2003 | Wile | 225/77 |

* cited by examiner

*Primary Examiner* — Sean Michalski
(74) *Attorney, Agent, or Firm* — Kenneth P. Glynn, Esq.; Deirdra M. Meagher, Esq.

(57) ABSTRACT

A plastic bag dispenser with side panels and guide bar includes: a) a base frame with a back and bottom section with open front adapted to hold a plastic bag roll; b) a swing arm and core rod adapted to receive a plastic bag roll for rotation and to move downwardly as the plastic bag roll is depleted; c) a first and second set of opposing side panels located on the base frame for stabilizing the movement of the plastic bag roll; d) an elongated open guide bar having a top and sides located on the open fronted bottom section for movement of bags from the plastic bag roll; and, e) a rip tongue located on the open fronted bottom section with an upward taper adapted to catch and separate a passing bag when pulled forward through the guide bar and over the rip tongue. Mounting mechanisms for the present invention are also detailed.

20 Claims, 16 Drawing Sheets

PLASTIC GROCERY BAG DISPENSER WITH SIDE PANELS AND GUIDE BAR

BACKGROUND OF INVENTION a. Field of Invention

The invention relates generally to dispensers for plastic bags from rolls, and particularly what are referred to as grocery bags (not limited to use in grocery stores or to be used for groceries, but commonly called plastic grocery bags or produce bags). The present invention dispenser uniquely provides a number of advantages and eliminates some common problems, including: ease of bag separation and removal, automatic threading and guiding of the unripped roll pull, stability of the roll, friction to prevent roll spinning, swing arm following of the roll thickness as it is depleted, modular adaptability for attachment to walls, countertops, counter and shelf bottoms, floors and short and tall stands.

b. Description of Related Art

The following patents are representative of the field pertaining to the present invention:

U.S. Pat. No. 7,424,963 B2 to Mark E. Daniels describes a wire frame plastic bag dispenser includes an angled lower bag roll support urging perforated, rolled plastic bags toward a bag roll restraining element attached to the frame. A constraining movement element prevents lateral movement of the bag roll. A perforation parter separates bags as they are pulled from the roll. The bags may be folded along at least one vertical axis to form a more compact bag roll and may have a chisel cut in the perforation to aid in separation by the perforation parter. The frame includes four corners each of approximately 90 degrees, has a C shape in a horizontal plane, and includes a dispensing end, a back end, and two sides. The lower bag roll support includes a proximal end attached to the back end and extends downwardly to a distal end. The perforation parter may be located outwardly from the dispensing end of the frame.

U.S. Pat. No. 7,270,256 B2 to Mark E. Daniels describes a series of roll mounted bags and dispensers are described. The bags may be folded along at least one axis and rolled. The compact roll of bags is placed in various dispensers. As the upper portion of the first bag is pulled from the roll, the roll will rotate, presenting the succeeding bag for dispensing after the first bag is removed. Variations of the dispenser include one with a bag opening means with a mounting member and bag opening element causing the bags to open as they are pulled from the dispenser. The dispenser includes mechanisms for supporting the bag roll and constraining its movement along its horizontal axis. Another variation of the dispenser has a perforation parting means that facilitates separation of one bag from a subsequent bag. The dispenser may be removably attached to a dispenser support that attaches to a surface.

U.S. Pat. No. 6,135,281 to Ebrahim Simhaee describes a continuous web of bags formed of a plurality of layers to be separated along a line of perforations that extends through all of the layers transverse of the web, in which at least one of the outermost layers is detached from the web at the separation line. Apparatus accomplishes this detachment in a moving web by engaging the outermost layer outer surface and exerting a force in a manner to produce the detachment from the separation line. Both the outermost upper and lower web layers can be detached at the separation line.

U.S. Pat. No. 5,934,535 to Charles Paul Kannankeril et al. describes a bag dispensing system providing plastic bags from a roll of bags where one end is attached to the top of the next bag by perforation lines with a slot therebetween. The roll of bags provides a core having an indexing member on at least one end. The dispenser comprising a wire frame formed into channels to support the core. The channels include a core retaining member for restraining the core in the channel. The dispenser includes at least one brake attached to a support member and disposed at an angle thereto to provide tension to the edges of the roll of bags as the core passes through the channel passageway as bags are removed from the roll. Spaced apart from the support is a separating tongue. The tongue engages the slot regardless of whether the bags are drawn over or under the tongue.

U.S. Pat. No. 5,752,666 to Ebrahim Simhaee describes a roll of plastic bags for use with a dispenser having opposing tracks in which the roll is supported, and a separating tongue for enabling individual bags to be separated from the roll. The roll of plastic bags is wound on an axle, the plastic bags being in a star sealed configuration. The ends of the axle project beyond the ends of the roll a distance sufficient to enable the axle to be supported for rotational and translational movement in the tracks in such a way that the roll frictionally engages a dispenser surface. Separation lines are provided between adjacent bags, a slot in each separation line being engageable by the tongue within the dispenser so that individual bags can be dispensed from the roll one at a time.

U.S. Pat. No. 5,558,262 to Ebrahim Simhaee describes a plastic bag dispenser holds a continuous roll of bags, connected by perforated separation lines. The dispenser is provided with a tongue, which the bags are dispensed over, that engages the separation line between the bag at the end of the roll and the next bag. This begins the separation of the separation line, as well as holds the next bag behind the tongue. A finger is provided on the upstream side of the tongue, with a gap between the finger and tongue. As a bag is separated, a portion of the front edge of the next bag is held in the gap, holding the bag in position for the next user. The roll of bags rests in curved grooves in the dispenser that cause the roll to abut and frictionally engage an interior surface of the dispenser, preventing free-wheeling of the roll. The curvature of the grooves causes the component of force which creates the frictional engagement to increase as the size of the roll decreases.

U.S. Pat. No. 5,556,019 to Joseph W. Morris describes a bag dispenser, for separating and dispensing a series of plastic bags where one end is attached to the top of the next bag by perforation lines with a slot therebetween. The series of bags are dispensed from a device comprising a wire frame formed into channels to support the core that the series of bags are rolled onto. The channels allow the core to rotate in place but restrict its linear movement to the vertical direction. The dispenser has two braking devices, a braking bar underneath the roll of bags and a pair of fingers that are attached to the channels to engage the core. The braking bar is positioned transversely to the series of bags so that it supports them. The pair of fingers does not engage the core until the number of bags on the core has decreased and the core has begun to descend. The two braking devices work in combination to retard the rotation and dispensing of the bags and thus to apply a tension to the series of bags. Attached to the frame is a separator with, preferably, a symmetric projection on its end. The projection will engage the slot regardless of whether the bags are drawn over or under the projection. Additionally, the separator is preferably coiled in its midsection to function as a spring. As the user pulls on the bags, a tension is created by the braking devices and the user to deflect the separator which remains deflected until the projection engages the slot.

Thus, when the separator engages the slot, the separator recoils through its normal position to facilitate the separation of the two bags.

U.S. Pat. No. 5,480,084 to Mark E. Daniels describes a rack for dispensing plastic bags from a roll of bags joined end-to-end and separated by a line of perforations and either an opening or a rupturable central area between the bags along the perforation line, comprising a rectangular cradle to hold the roll for removal of bags by unrolling them over a horizontal side element and past a pair of snagging elements which intercept the rupturable central area to restrain each ensuing bag as the preceding bag is pulled away from the roll so as to enable the preceding bag to be separated from the ensuing bag along the perforated and open or rupturable central area line. Provision is made to enable the cradle to be mounted either on or under a store counter, or against a wall.

U.S. Pat. No. 5,219,424 to Ebrahim Simhaee describes a roll of plastic bags is wound on an axle which is adapted to be retained within a dispensing device. The bags may be of any configuration but, preferably, are of the type known as a star seal with individual bags separated by perforated separation lines. The bags are wound around a core which can be retained on the axle so that the roll can rotate with respect to the axle when the axle is fixed within the dispensing device. A slot is provided in each separation line between adjacent bags, the slot adapted to engage a complementary tongue in the dispensing device for separating the individual bags. The width of the roll is such relative to the tongue that when an individual bag has been separated from the roll, portions of the next bag on the roll extend forwardly of the tongue where they are in a position to be grasped by a user and subsequently severed from the roll. The roller may include a feature for retarding rotation of the roll of bags relative to the axle.

U.S. Pat. No. 5,209,371 to Mark E. Daniels describes a method and device for dispensing T-shirt type plastic bags from a roll joined end to end in series but separable along perforated lines where the bag ends are connected, whereby the bags are rolled and the roll of bags is placed in a cradle for unrolling and passing between two bars above and parallel to the axis of the roll, at least one of the bars having a centrally disposed hooking snagging element past which the series of bags is drawn. When the open space between the straps of each T-shirt bag passes the snagging element, the latter catches the leading edge of the ensuing bag to restrain it sufficiently so that further pulling on the preceding bag results in its detachment along the perforated line for the ensuing bag. Rack means are provided to enable the method to be practiced.

Notwithstanding the prior art, the present invention is neither taught nor rendered obvious thereby.

SUMMARY OF INVENTION

The invention solves the problems and overcomes the drawbacks and deficiencies of prior art including: ease of bag separation and removal, automatic threading and guiding of the unripped roll pull, stability of the roll, required friction to prevent roll spinning, swing arm following of the roll thickness as it is depleted, and modular adaptability for attachment to walls, countertops, counter and shelf bottoms, floors and short and tall stands.

The present invention plastic bag dispenser with side panels and guide bar includes: a) a base frame including a back section and a bottom section, together adapted to receive and nest a plastic bag roll, the bottom section having an open front; b) a plastic bag roll holding mechanism moveably attached to the base frame, the holding mechanism including a swing arm and a core rod, the core rod adapted to receive a plastic bag roll for rotation therein and adapted to move downwardly via gravity as a plastic bag roll is depleted thereon; c) a first set of opposing side panels, located on the back section of the base frame for stabilizing the movement of a nested plastic bag roll; d) a second set of opposing side panels, located on the bottom section of the base frame for stabilizing the movement of a nested plastic bag roll; e) an elongated open guide bar for movement of bags from a nested roll of plastic bags, the guide bar having at least a top and sides and located toward the open front of the bottom section of the base frame; and, f) a rip tongue located on the open front of the bottom section of the base frame and having an upward taper and adapted to catch and separate a passing bag from a nested plastic bag roll when pulled forward through the guide bar and over the rip tongue.

In some preferred embodiments of the present invention, the rip tongue has a triangular shape and said opposing forward side guards include a taper that is directed inwardly and downwardly.

In some preferred embodiments of the present invention, the base frame may be a plate base frame of a material selected from the croup consisting of metal material, plastic material, composite material and combinations thereof.

In some preferred embodiments of the present invention, the guide bar is a wire loop guide bar.

In some preferred embodiments of the present invention, the dispenser further includes: g) an attachment mechanism attached to the frame for attachment to a support selected from the group consisting of a vertical surface mount, a horizontal surface mount and a post mount.

In some preferred embodiments of the present invention, the attachment mechanism is a tubular member extending away from the base frame for attachment to a support wherein the support is a receiving tubular support.

In some preferred embodiments of the present invention, the first set of opposing side panels have predetermined size and shape to permit the core rod on the swing arm to move past the first set of opposing side panels.

In some preferred embodiments of the present invention, the second set of opposing side panels have predetermined size and shape to permit the core rod on the swing arm to move over and behind the second set of opposing side panels.

In some preferred embodiments of the present invention, the back section of the base frame includes a friction component against which a plastic bag roll engages to inhibit free opening.

In some preferred embodiments of the present invention, the core rod includes plastic bag roll stops to inhibit lateral movement of a nested plastic bag roll.

In some other preferred embodiments of the present invention, which may include any of the features set above, a plastic bag dispenser with side panels and guide bar includes: a) a base frame including a back sections and a bottom section, together adapted to receive and nest a plastic bag roll, the bottom section having an open front; b) a plastic bag roll holding mechanism moveably attached to the base frame, the holding mechanism including a swing arm and a core rod, the core rod adapted to receive a plastic bag roll for rotation therein and adapted to move downwardly via gravity as a plastic bag roll is depleted thereon; c) a first set of opposing side panels, located on the back section of the base frame for stabilizing the movement of a nested plastic bag roll; d) a second set of opposing side panels, located on the bottom section of the base frame for stabilizing the movement of a nested plastic bag roll; e) an elongated open guide bar for movement of bags from a nested roll of plastic bags, the guide bar having at least a top and sides and located toward the open front of the bottom section of the base frame; f) one set of opposing forward side guards located on the bottom section of the base frame extending upwardly therefrom, the set of opposing forward side guards being located between the second set of opposing side panels and the open front; and, g) a rip tongue located on the open front of the bottom section of the base frame and having an upward taper and adapted to catch and separate a passing bag from a nested plastic bag roll when pulled forward through the guide bar and over the rip tongue.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 1:
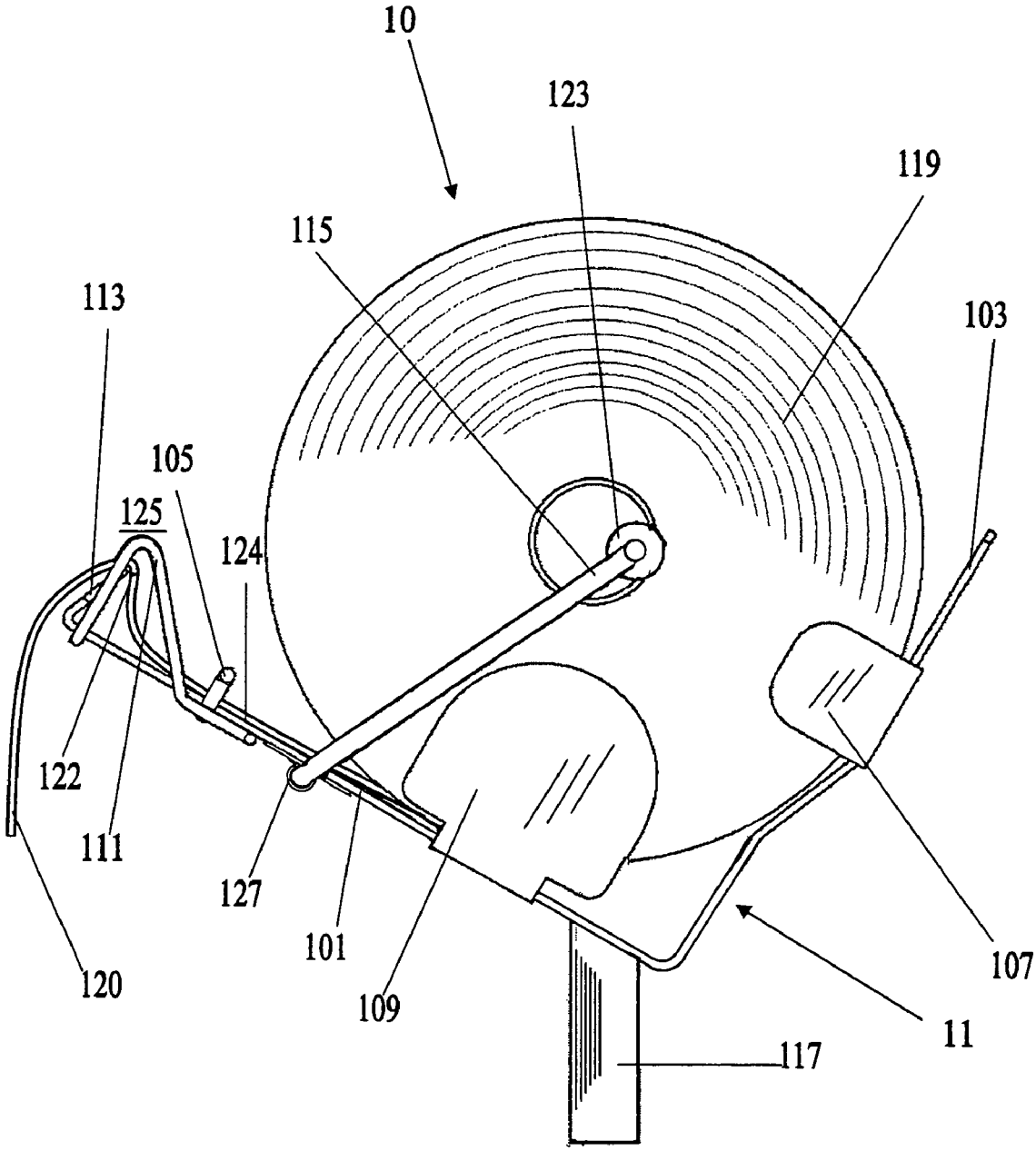
FIG. 1 is a side view of an embodiment of a plastic bag dispenser with side panels and guide bar according to the present invention with a plastic bag roll nested in the present invention.

Referring now to the drawings wherein like reference numerals designate corresponding parts throughout the several views, FIG. 1 through FIG. 6.

FIG. 1 is a side view of an embodiment of a plastic bag dispenser 10 according to the present invention; with a plastic bag roll 119 nested therein as more fully described below. The base frame 11 of the plastic bag dispenser 10 is composed of bottom section 101 and of back section 103. Bottom section 101 has an open front 125. Attachment means 117 is attached to the bottom section 101 and adapted to attach the plastic bag dispenser 10 to a mounting bracket such as a vertical surface mount, a floor stand mount, or a horizontal surface mount, as described below.

A first set of opposing side panels 107 is mounted to back section 103 of the base frame 11 to stabilize the movement of a nested plastic bag roll 119. In this embodiment, first set of opposing side panels 107 project forward at a right angles on opposite sides of back section 103. A second set of opposing side panels 109 is located on the bottom section 101 of the base frame 11 to also stabilize the movement of a nested plastic bag roll 119. In this embodiment, second set of opposing side panels 109 project forward at a right angles on opposite sides of bottom section 101.

An elongated open guide bar 105 for movement of plastic bag 120 from the nested plastic bag roll 119 is located toward the open front 125 of the bottom section 101 of the base frame 11. Elongated open guide bar 105 is adapted to assist the movement of plastic bag 120 from the plastic bag roll 119. In the present embodiment, elongated open guide bar 105 is a loop of material located on the bottom section 101 of base frame 11 and oriented perpendicularly therefrom. Forward side guard 111 is located at open front 125 on base section 101 to maintain proper alignment of plastic bag 120 over the rip tongue 113.

Rip tongue 113 is located at the open front 125 of bottom section 101 and is transverse to bottom section 101. Rip tongue 113 is adapted to catch and separate a passing bag 120 from a nested plastic bag roll 119.

A swing arm 115 is located along bottom section 101 of the base frame 11. In the present embodiment of the plastic bag dispenser 10, swing arm 115 is generally "L" shaped, with a right angle bend where it extends past the depth of the bottom section 101. The swing arm 115 is attached to the bottom section 101 by swing arm base 127. In the present embodiment of the plastic bag dispenser 10, swing arm base 127 is a mounting bracket with a recess adapted to allow swing arm 115 to act as an axle when couple with swing arm base 127. A plastic bag roll stop 123 is located at the free end of swing arm 115 and is adapted to keep plastic bag roll 119 in place during use. As plastic bag roll 119 is depleted, the swing arm 115 rotates about swing arm base 127 towards bottom section 101 and rear section 103 of base frame 11.

To operate the present invention plastic bag dispenser, a plastic bag 120 is pulled down over the rip tongue 113. This causes nested plastic bag roll 119 to unroll until perforations 122 in plastic bag 120 pass over the rip tongue 113. As the perforations 122 pass over rip tongue 113 the plastic bag 120 separates from the nested plastic bag roll 119. The next plastic bag 124 on the nested plastic bag roll 119 is then positioned in the open front 125 for use. The plastic bag roll 119 is prevented from unraveling when not in use by friction between the plastic bag roll 119 and the bottom section 101 and back section 103 of base frame 11.

Figure 2:
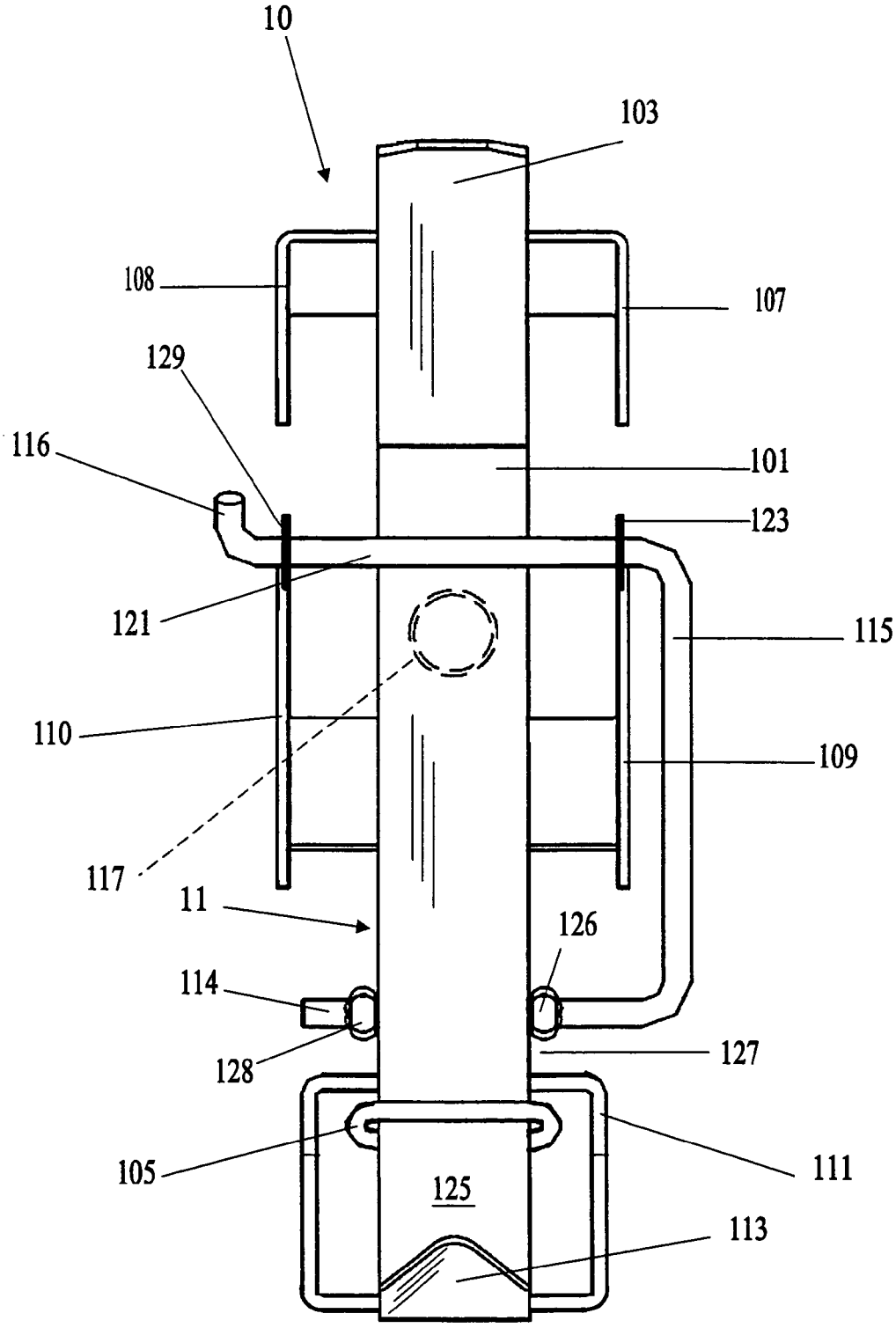
FIG. 2 is a top view of the plastic bag dispenser with side panels and guide bar of FIG. 1 with the plastic bag holding swing arm in an elevated position.

FIG. 2 is a top view of the plastic bag dispenser 10 of FIG. 1 with the swing arm 15 in an elevated positioned. The base frame 11 of the plastic bag dispenser 10 is composed of bottom section 101 and back section 103. Bottom section 101 has an open front 125. Attachment means 117 is mounted to the bottom section 101 and adapted to attach the plastic bag dispenser 10 to a mounting bracket such as a vertical surface mount, a floor stand mount, or a horizontal surface mount, as described below.

A first set of opposing side panels 107 and 108 are located on the back section 103 of the base frame 11. First set of opposing side panels 107 and 108 project forward at right angles on opposite sides of back section 103. A second set of opposing side panels 109 and 110 are located on the bottom section 101 of the base frame 11. Second set of opposing side panels 109 and 110 project forward at right angles on opposite sides of bottom section 101.

An elongated open guide bar 105 is located toward the open front 125 of the bottom section 101 of the base frame 11. The elongated open guide bar 105 in the present configuration is a wire loop around the open front 125 of bottom section 101. A forward side guard 111 is located near the elongated open guide bar 105 and attached to the bottom section 101 of base frame 11. Rip tongue 113 is located on the open front 125 of bottom section 101 of the base frame 11. The rip tongue 113 is designed with an upward taper on the end to improve its functionality during use.

A swing arm 115 is located along bottom section 101 of the base frame 11. In the present embodiment of the plastic bag dispenser 10, swing arm 115 and the lower swing arm section 114 generally form an "L" shaped, with a right angle bend where they connect. The swing arm 115 is attached to the bottom section 101 by passing lower swing arm section 114 through swing arm base 127. Lower swing arm section 114 is kept from sliding out by axel stops 126 and 128, which are compression sleeves attached to lower swing arm section 114 on both sides of mounting bracket 127 in the present embodiment. In the present embodiment of the plastic bag dispenser 10, swing arm base 127 is a mounting bracket with a recess adapted to allow lower swing arm section 114 to act as an axle when couple with swing arm base 127.

Core rod 121 is located at the free end of swing arm 115 such that the lower swing arm section 114, swing arm 115, and core rod 121 generally form a "C" shape. In other embodiments of the present invention, the lower swing arm section 114, swing arm 115, and core rod 121 may take other shapes. Plastic bag roll stops 123 and 129 are located on core rod 121. In the present configuration of plastic bag dispenser 10, plastic bag roll stops 123 and 129 are washers, however other designs may be used. The core rod 121 terminates after plastic bag roll stop 129 in a bend 116 that is adapted to also assist in maintaining proper alignment and position of the present invention plastic bag dispenser 10 during use.

Figure 3:
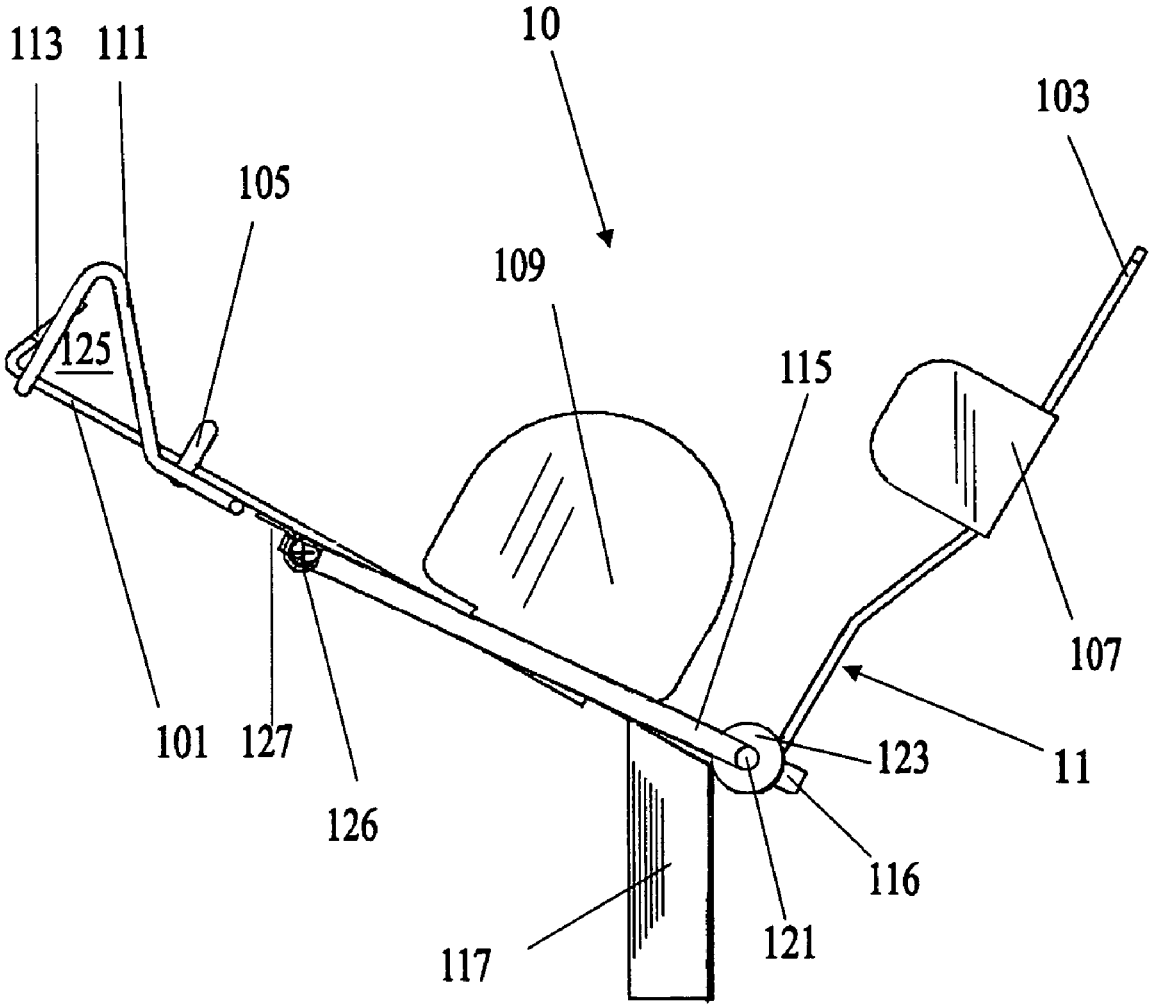
FIG. 3 is a side view of an embodiment of a plastic bag dispenser with side panels and guide bar without a nested plastic bag roll and with the plastic bag holding swing arm resting on the base frame.

FIG. 3 is a side view of an embodiment of a plastic bag dispenser 10 with the swing arm 115 resting on the base frame 11. The base frame 11 of the plastic bag dispenser 10 is composed of bottom section 101 and back section 103. Bottom section 101 has an open front 125. Attachment means 117 is attached to the bottom section 101 and adapted to attach the plastic bag dispenser 10 to a mounting bracket such as a vertical surface mount, a floor stand mount, or a horizontal surface mount, as described below.

A first set of opposing side panels 107 is mounted to back section 103 of the base frame 11 to provide stability while the device is in use. In this embodiment, first set of opposing side panels 107 project forward at right angles on opposite sides of back section 103. A second set of opposing side panels 109 is located on the bottom section 101 of the base frame 11 to also provide stability while the device is in use. In this embodiment, second set of opposing side panels 109 project forward at right angles on opposite sides of bottom section 101.

An elongated open guide bar 105 is located toward the open front 125 of the bottom section 101 of the base frame 11. Elongated open guide bar 105 is adapted to assist the movement of the present device during use. In the present embodiment, elongated open guide bar 105 is a loop of material located on the bottom section 101 of base frame 11 and oriented perpendicularly therefrom. Forward side guard 111 is located at open front 125 on base section 101 and adapted to maintain proper device alignment over the rip tongue 113 when the invention is in use. Rip tongue 113 is located at the open front 125 of bottom section 101 and is transverse to bottom section 101.

A swing arm 115 is located along bottom section 101 of the base frame 11. The swing arm 115 is attached to the bottom section 101 by swing arm base 127. In the present embodiment of the plastic bag dispenser 10, swing arm base 127 is a mounting bracket with a recess adapted to allow swing arm 115 to act as an axle when couple with swing arm base 127. The swing arm 115 is held in place in swing arm base 127 by axel stop 126.

Core rod 121 is located at the free end of swing arm 115 perpendicularly therefrom. Plastic bag roll stop 123 is located on core rod 121. In the present configuration of plastic bag dispenser 10, plastic bag roll stop 123 is a washer, however other designs may be used. The core rod 121 terminates in a bend 116 that is adapted to also assist in maintaining proper alignment and position of the present invention plastic bag dispenser 10 during use.

Figure 4:
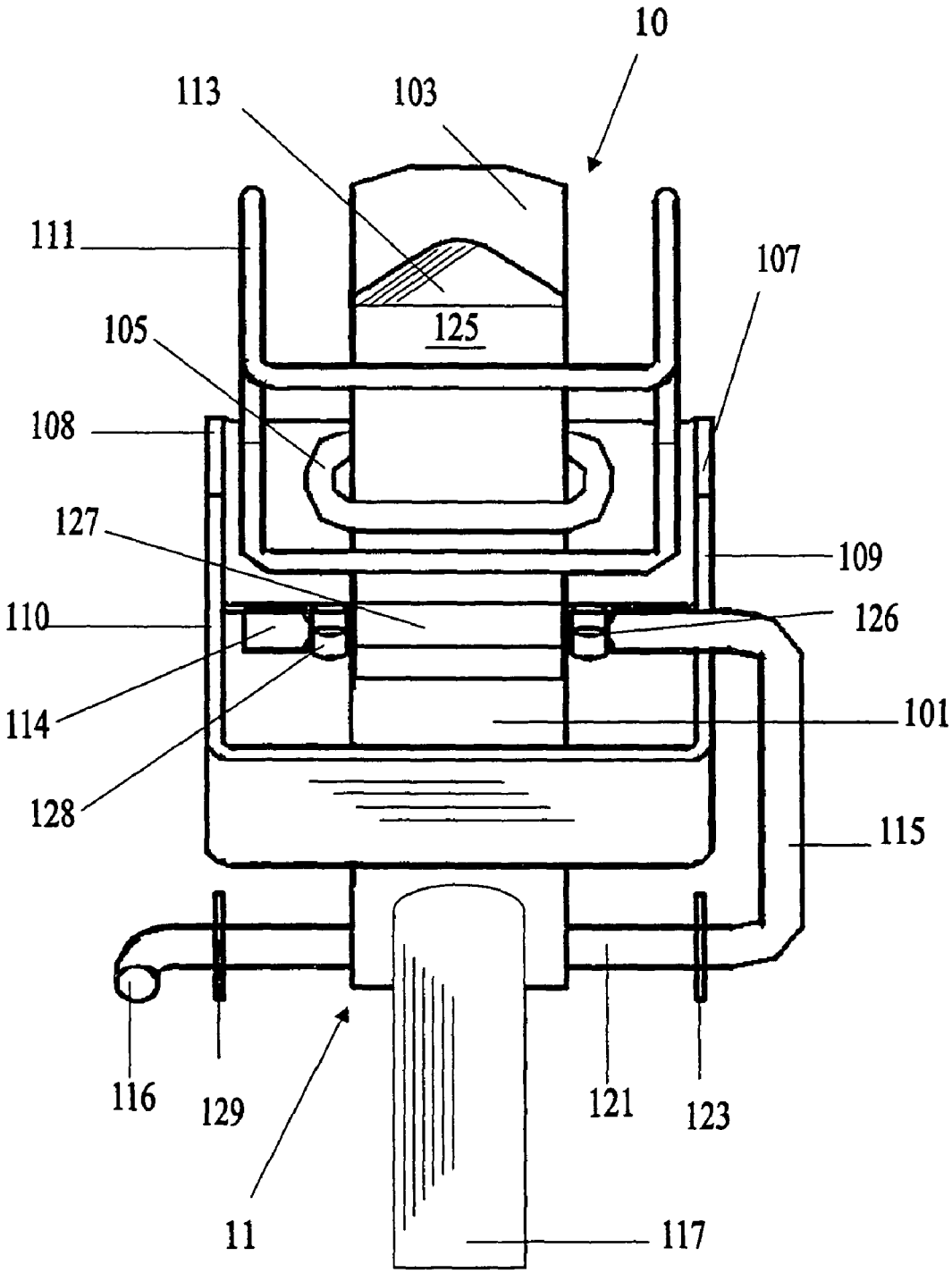
FIG. 4 is a front view of the embodiment of a plastic bag dispenser with side panels and guide bar of FIG. 3.

FIG. 4 is a front view of the plastic bag dispenser 10 of FIG. 3, better illustrating the vertical spatial arrangement of the components. The base frame 11 of the plastic bag dispenser 10 is composed of bottom section 101 and back section 103. Bottom section 101 has an open front 125. Attachment means 117 is mounted to the bottom section 101 and adapted to attach the plastic bag dispenser 10 to a mounting bracket such as a vertical surface mount, a floor stand mount, or a horizontal surface mount, as described below.

A first set of opposing side panels 107 and 108 are located on the back section 103 of the base frame 11. First set of opposing side panels 107 and 108 project forward at right angles on opposite sides of back section 103. A second set of opposing side panels 109 and 110 are located on the bottom section 101 of the base frame 11. Second set of opposing side panels 109 and 110 project forward at right angles on opposite sides of bottom section 101.

An elongated open guide bar 105 is located toward the open front 125 of the bottom section 101 of the base frame 11. The elongated open guide bar 105 in the present configuration is a wire loop around the open front 125 of bottom section 101. A forward side guard 111 is located near the elongated open guide bar 105 and attached to the bottom section 101 of base frame 11. Rip tongue 113 is located on the open front 125 of bottom section 101 of the base frame 11. The rip tongue 113 is designed with an upward taper on the end to improve its functionality during use.

A swing arm 115 is located along bottom section 101 of the base frame 11. In the present embodiment of the plastic bag dispenser 10, swing arm 115 and the lower swing arm section 114 generally form an "L" shaped, with a right angle bend where they connect. The swing arm 115 is attached to the bottom section 101 by passing lower swing arm section 114 through swing arm base 127. Lower swing arm section 114 is kept from sliding out by axel stops 126 and 128, which are compression sleeves attached to lower swing arm section 114 on both sides of mounting bracket 127 in the present embodiment. In the present embodiment of the plastic bag dispenser 10, swing arm base 127 is a mounting bracket with a recess adapted to allow lower swing arm section 114 to act as an axle when couple with swing arm base 127.

Core rod 121 is located at the free end of swing arm 115 such that the lower swing arm section 114, swing arm 115, and core rod 121 generally form a "C" shape. In other embodiments of the present invention, the lower swing arm section 114, swing arm 115, and core rod 121 may take other shapes. Plastic bag roll stops 123 and 129 are located on core rod 121. In the present configuration of plastic bag dispenser 10, plastic bag roll stops 123 and 129 are washers, however other designs may be used. The core rod 121 terminates after plastic bag roll stop 129 in a bend 116 that is adapted to also assist in maintaining proper alignment and position of the present invention plastic bag dispenser 10 during use.

Figure 5:
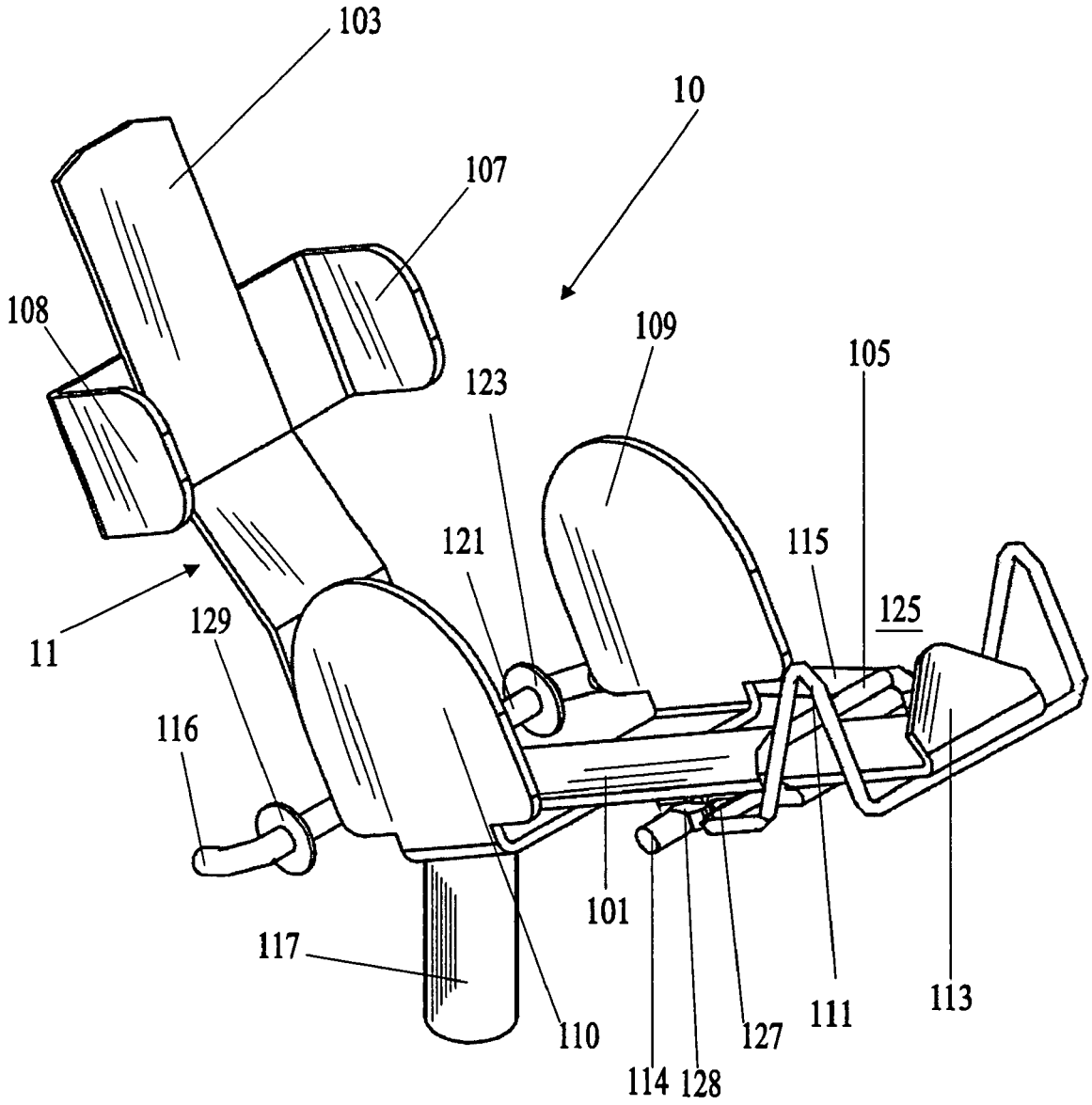
FIG. 5 is a right side oblique view of the plastic bag dispenser with side panels and guide bar of FIG. 3.

FIG. 5 is a right side oblique view of the plastic bag dispenser 10 of FIG. 3, further illustrating the relative arrangement of the components. The base frame 11 of the plastic bag dispenser 10 is composed of bottom section 101 and back section 103. Bottom section 101 has an open front 125. Attachment means 117 is mounted to the bottom section 101 and adapted to attach the plastic bag dispenser 10 to a mounting bracket such as a vertical surface mount, a floor stand mount, or a horizontal surface mount, as described below.

A first set of opposing side panels 107 and 108 are located on the back section 103 of the base frame 11. First set of opposing side panels 107 and 108 project forward at right angles on opposite sides of back section 103. A second set of opposing side panels 109 and 110 are located on the bottom section 101 of the base frame 11. Second set of opposing side panels 109 and 110 project forward at right angles on opposite sides of bottom section 101.

An elongated open guide bar 105 is located toward the open front 125 of the bottom section 101 of the base frame 11. The elongated open guide bar 105 in the present configuration is a wire loop around the open front 125 of bottom section 101. A forward side guard 111 is located near the elongated open guide bar 105 and attached to the bottom section 101 of base frame 11. Rip tongue 113 is located on the open front 125 of bottom section 101 of the base frame 11. The rip tongue 113 is designed with an upward taper on the end to improve its functionality during use.

A swing arm 115 is located along bottom section 101 of the base frame 11. In the present embodiment of the plastic bag dispenser 10, swing arm 115 and the lower swing arm section 114 generally form an "L" shaped, with a right angle bend where they connect. The swing arm 115 is attached to the bottom section 101 by passing lower swing arm section 114 through swing arm base 127. Lower swing arm section 114 is kept from sliding out by axel stop 128, which is a compression sleeve attached to lower swing arm section 114 outside mounting bracket 127 in the present embodiment. In the present embodiment of the plastic bag dispenser 10, swing arm base 127 is a mounting bracket with a recess adapted to allow lower swing arm section 114 to act as an axle when couple with swing arm base 127.

Core rod 121 is located at the free end of swing arm 115 such that the lower swing arm section 114, swing arm 115, and core rod 121 generally form a "C" shape. In other embodiments of the present invention, the lower swing arm section 114, swing arm 115, and core rod 121 may take other shapes. Plastic bag roll stops 123 and 129 are located on core rod 121. In the present configuration of plastic bag dispenser 10, plastic bag roll stops 123 and 129 are washers, however other designs may be used. The core rod 121 terminates after plastic bag roll stop 129 in a bend 116 that is adapted to also assist in maintaining proper alignment and position of the present invention plastic bag dispenser 10 during use.

Figure 6:
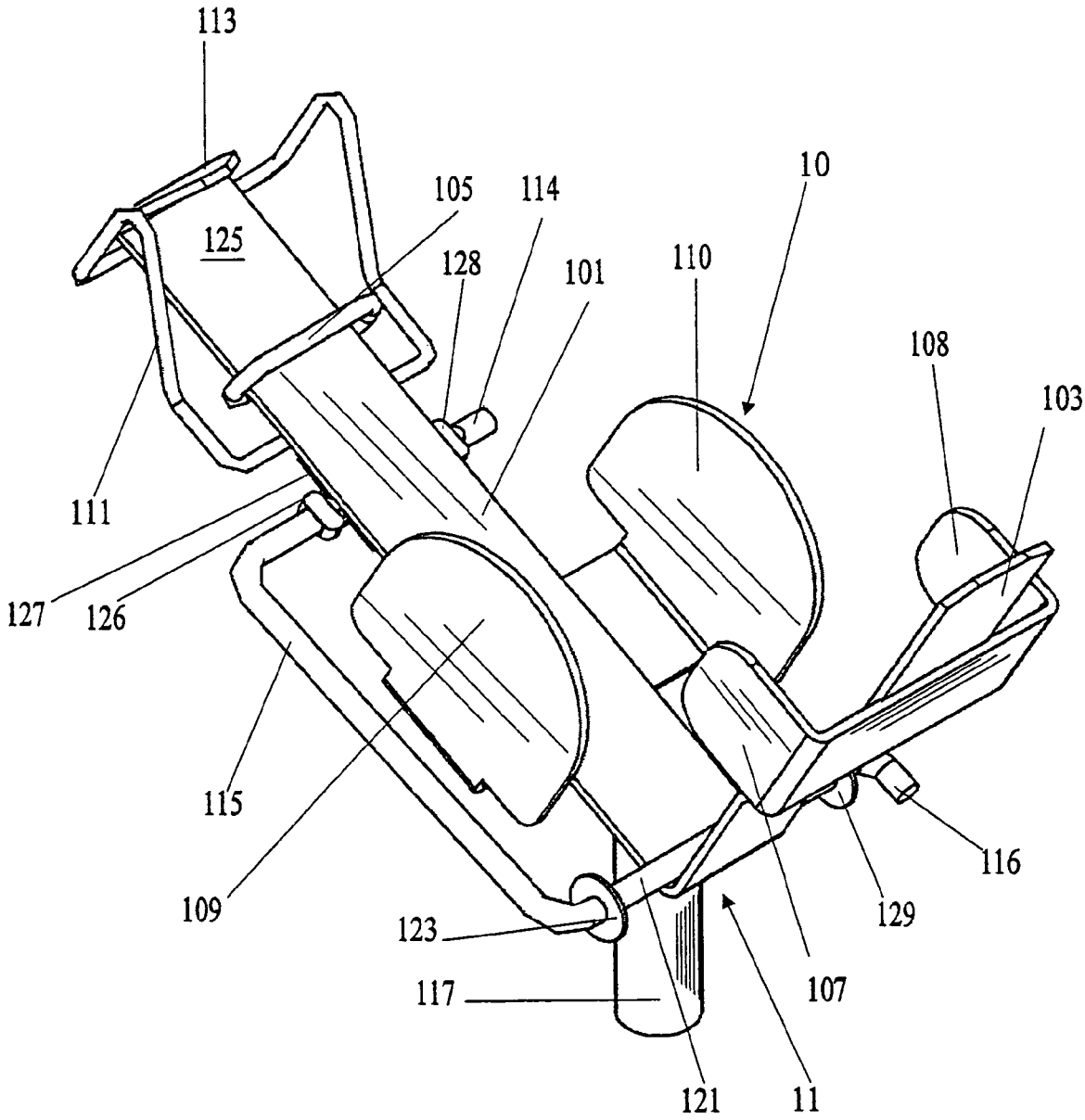
FIG. 6 is a top oblique view of the plastic bag dispenser with side panels and guide bar of FIG. 3.

FIG. 6 is a top oblique view of the plastic bag dispenser 10 of FIG. 3, further illustrating the arrangement of the components. The base frame 11 of the plastic bag dispenser 10 is composed of bottom section 101 and back section 103. Bottom section 101 has an open front 125. Attachment means 117 is mounted to the bottom section 101 and adapted to attach the plastic bag dispenser 10 to a mounting bracket such as a vertical surface mount, a floor stand mount, or a horizontal surface mount, as described below.

A first set of opposing side panels 107 and 108 are located on the back section 103 of the base frame 11. First set of opposing side panels 107 and 108 project forward at right angles on opposite sides of back section 103. A second set of opposing side panels 109 and 110 are located on the bottom section 101 of the base frame 11. Second set of opposing side panels 109 and 110 project forward at right angles on opposite sides of bottom section 101.

An elongated open guide bar 105 is located toward the open front 125 of the bottom section 101 of the base frame 11. The elongated open guide bar 105 in the present configuration is a wire loop around the open front 125 of bottom section 101. A forward side guard 111 is located near the elongated open guide bar 105 and attached to the bottom section 101 of base frame 11. Rip tongue 113 is located on the open front 125 of bottom section 101 of the base frame 11. The rip tongue 113 is designed with an upward taper on the end to improve its functionality during use.

A swing arm 115 is located along bottom section 101 of the base frame 11. In the present embodiment of the plastic bag dispenser 10, swing arm 115 and the lower swing arm section 114 generally form an "L" shaped, with a right angle bend where they connect. The swing arm 115 is attached to the bottom section 101 by passing lower swing arm section 114 through swing arm base 127. Lower swing arm section 114 is kept from sliding out by axel stop 128, which is a compression sleeve attached to lower swing arm section 114 outside mounting bracket 127 in the present embodiment. In the present embodiment of the plastic bag dispenser 10, swing arm base 127 is a mounting bracket with a recess adapted to allow lower swing arm section 114 to act as an axle when couple with swing arm base 127.

Core rod 121 is located at the free end of swing arm 115 such that the lower swing arm section 114, swing arm 115, and core rod 121 generally form a "C" shape. In other embodiments of the present invention, the lower swing arm section 114, swing arm 115, and core rod 121 may take other shapes. Plastic bag roll stops 123 and 129 are located on core rod 121. In the present configuration of plastic bag dispenser 10, plastic bag roll stops 123 and 129 are washers, however other designs may be used. The core rod 121 terminates after plastic bag roll stop 129 in a bend 116 that is adapted to also assist in maintaining proper alignment and position of the present invention plastic bag dispenser 10 during use.

Figure 7:
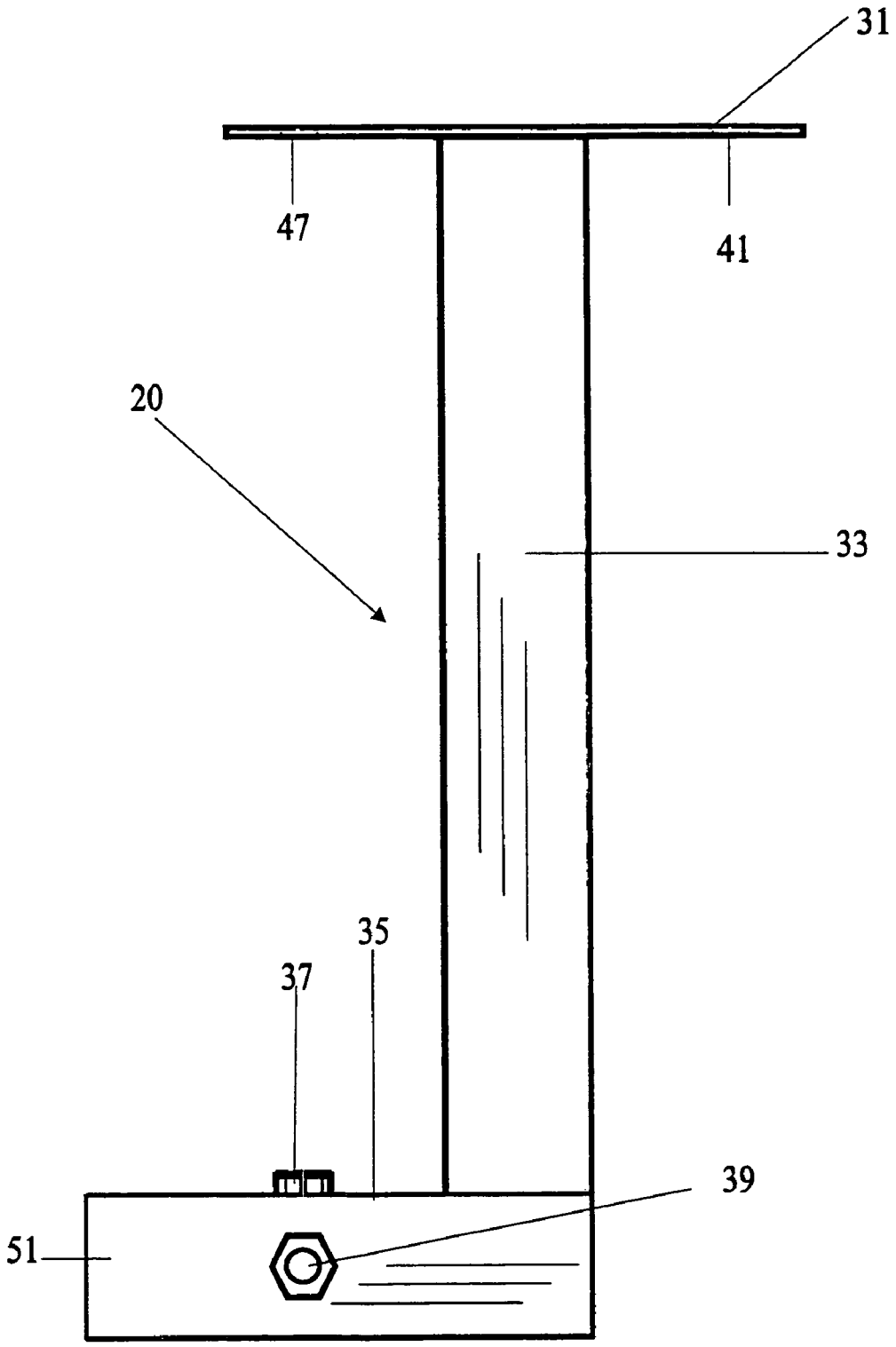
FIG. 7 is a side view of wall mounting bracket for the present invention bag dispenser with side panels and guide bar.
Figure 8:
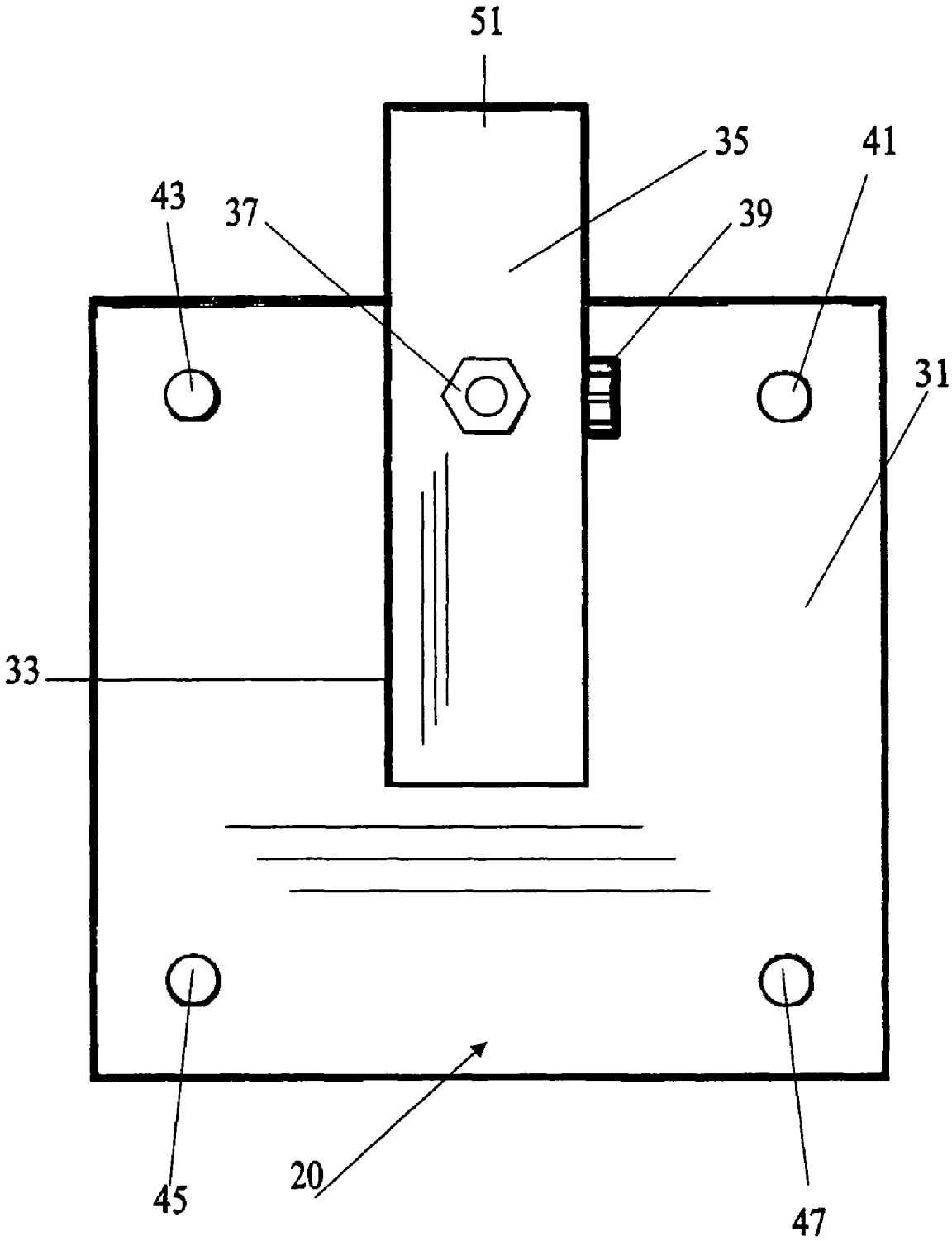
FIG. 8 is a front view of the wall mounting bracket of FIG. 7.
Figure 9:
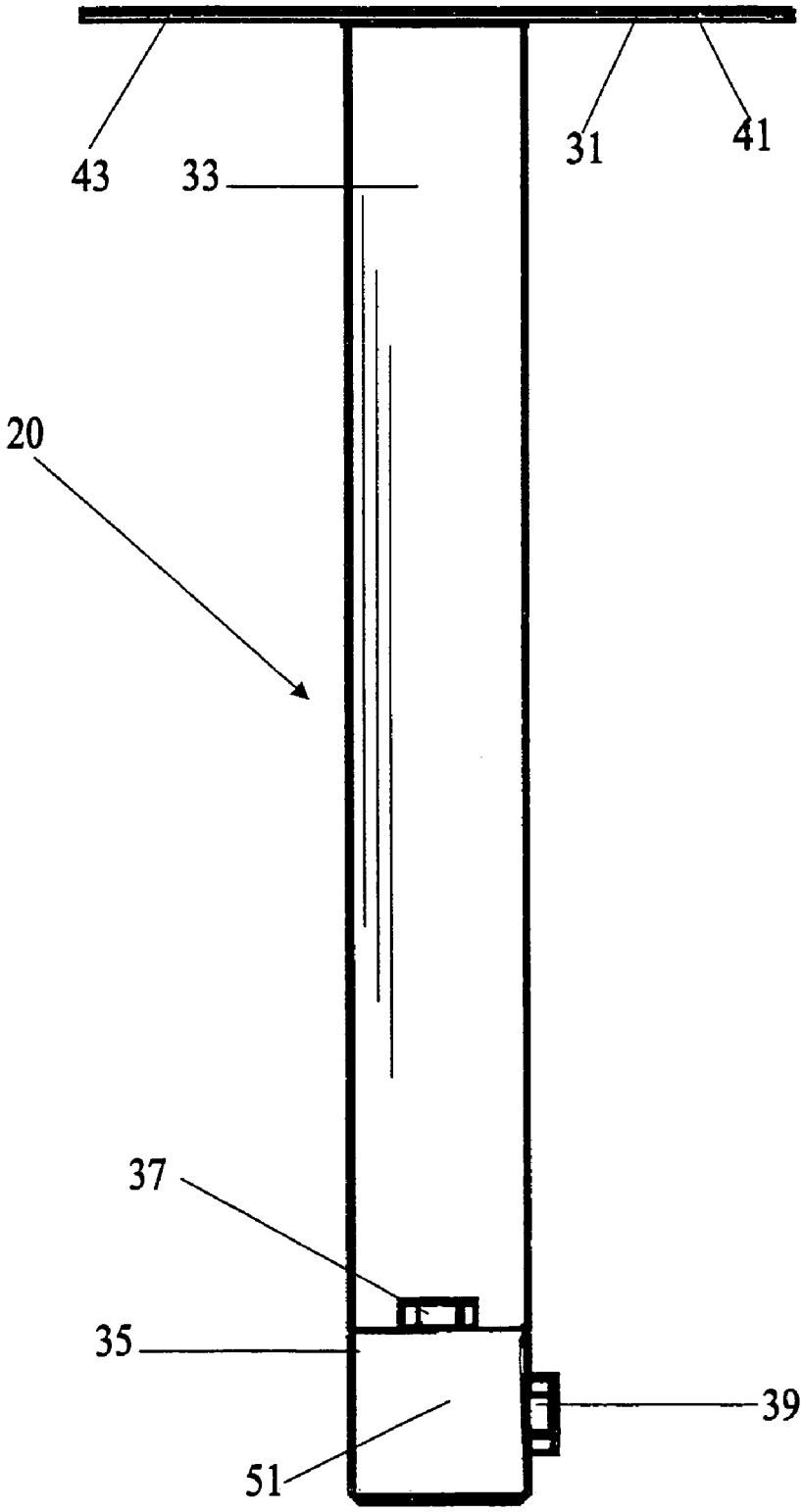
FIG. 9 is a top view of the wall mounting bracket of FIG. 7.

Referring now to the drawings wherein like reference numerals designate corresponding parts throughout the several views, FIG. 7 through FIG. 9.

FIG. 7 is a side view of wall mounting bracket 20 adapted for fixing the present invention bag dispenser with side panels and guide bar to vertical surfaces. Wall mounting bracket 20 consists of a flat mounting plate 31, horizontal mounting frame 33, vertical mounting frame 35, and nuts 37 and 39. Flat mounting plate 31 can be secured to a vertical surface, such as a wall, by passing anchoring mechanisms, such as screws, through holes 41 and 47. Horizontal mounting frame 33 is perpendicularly connected to flat mounting plate 31. In this embodiment, the horizontal mounting frame 33 is a hollow box structure, although other materials may be used.

Vertical mounting frame 35 is perpendicularly connected to horizontal mounting frame 33 such that the length of vertical mounting frame 35 extends upward from horizontal mounting frame 33 and has an opening 51 at the highest end. The present invention plastic bag dispenser with side panels and guide can be connected to the wall mounting bracket 20 by sliding the attachment means described above into the opening 51 of vertical mounting frame 35.

Nuts 37 and 39 are located on adjacent sides of vertical mounting frame 35 to allow the present invention plastic bag dispenser with side panels and guide to be secured to the wall mounting bracket 20 in multiple orientations. Once the present invention plastic bag dispenser with side panels and guide is connected to the wall mounting bracket 20 in the desired orientation, a screw will be threaded into one of the two nuts 37 or 39 to lock the plastic bag dispenser into place.

FIG. 8 is a front view of the wall mounting bracket 20 of FIG. 7, better illustrating the flat mounting plate 31. Flat mounting plate 31 can be secured to a vertical surface such as a wall by passing anchoring mechanisms, such as screws, through holes 41, 43, 45 and 47. Horizontal mounting frame 33 is perpendicularly connected to flat mounting plate 31. In this embodiment, the horizontal mounting frame 33 is a hollow box structure, although other materials may be used.

Vertical mounting frame 35 is perpendicularly connected to horizontal mounting frame 33 such that the length of vertical mounting frame 35 extends upward from horizontal mounting frame 33 and has an opening 51 at the highest end. The present invention plastic bag dispenser with side panels and guide can be connected to the wall mounting bracket 20 by sliding the attachment means as described above into the opening 51 of vertical mounting frame 35.

Nuts 37 and 39 are located on adjacent sides of vertical mounting frame 35 to allow the present invention plastic bag to be secured to the wall mounting bracket 20 in multiple orientations. Once the plastic bag dispenser is connected to the wall mounting bracket 20 in the desired orientation, a screw or similar mechanism will be threaded into one of the nuts 37 or 39 to lock the plastic bag dispenser with side panels and guide into place.

FIG. 9 is a top view of the wall mounting bracket 20 of FIG. 7, better illustrating the depth of the components. Wall mounting bracket 20 consists of a flat mounting plate 31, horizontal mounting frame 33, vertical mounting frame 35, and nuts 37 and 39. The wall mounting bracket includes a flat mounting plate 31 that can be secured to a vertical surface such as a wall by passing anchoring mechanisms, such as screws, through holes 41 and 43. Horizontal mounting frame 33 is perpendicularly connected to flat mounting plate 31. In this embodiment, the horizontal mounting frame 33 is a hollow box structure, although other materials may be used.

Vertical mounting frame 35 is perpendicularly connected to horizontal mounting frame 33 such that the length of vertical mounting frame 35 extends upward from horizontal mounting frame 33 and has an opening 51 at one end. The present invention plastic bag dispenser can be connected to the wall mounting bracket 20 by sliding the attachment means as described above into the opening 51 of vertical mounting frame 35.

Nuts 39 and 37 are located on adjacent sides of vertical mounting frame 35 to allow the present invention plastic bag dispenser to be secured to the wall mounting bracket 20 in multiple orientations. Once the plastic bag dispenser with side panels and guide is connected to the wall mounting bracket in the desired orientation, a screw will be threaded into one of the two nuts 37 or 39 to lock the plastic bag dispenser with side panels and guide into place.

Figure 10:
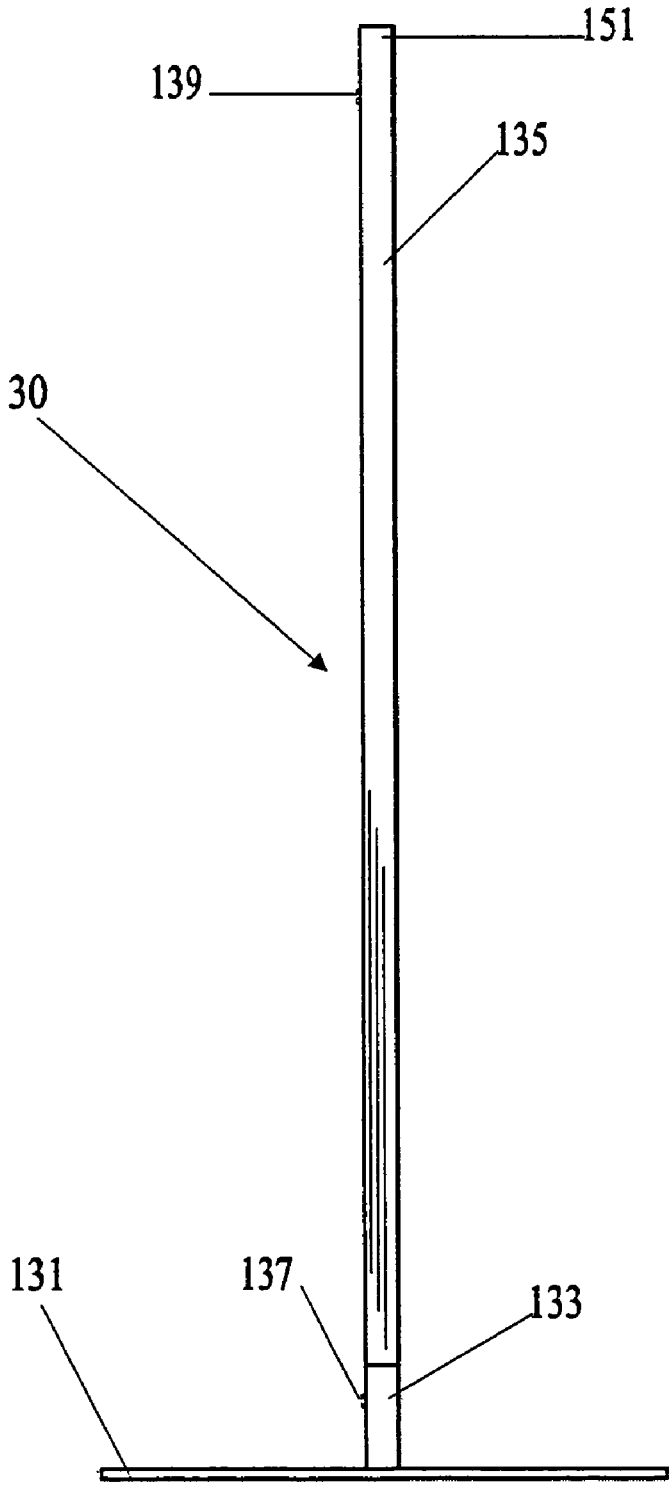
FIG. 10 is a front view of a floor stand for the present invention bag dispenser with side panels and guide bar.

FIG. 10 is a front view of a floor stand 30 that allows the present invention bag dispenser to be mounted and stood on any flat horizontal surface, such as a floor. It includes a flat base plate 131 that can be laid on any flat horizontal surface. Vertical mounting bracket 133 is centrally connected perpendicular to flat base plate 131.

The vertical mounting bracket 133 is hollow to allow it to connect with vertical mounting frame 135, which can be inserted into vertical mounting bracket 133. Nut 137 is located on the outside of vertical mounting bracket 133 to lock the vertical mounting bracket 133 and vertical mounting frame 135 together with a suitable mechanism, such as a threaded screw. The present invention plastic bag dispenser can be connected to the floor stand 30 by sliding the attachment means described above into the opening 151 at the end of vertical mounting frame 135, which may be made out of a hollow material such as box steel.

Nut 139 is located on vertical mounting frame 135 to allow the present invention plastic bag dispenser to be secured to the floor stand 30 through the use of a suitable mechanism, such as a threaded screw. Unlike the embodiment of the present invention depicted in FIG. 7, FIG. 8, and FIG. 9, only a single nut 139 is required since the entire floor stand 30 may be moveably placed to properly orient the present invention plastic bag for use.

Figure 11:
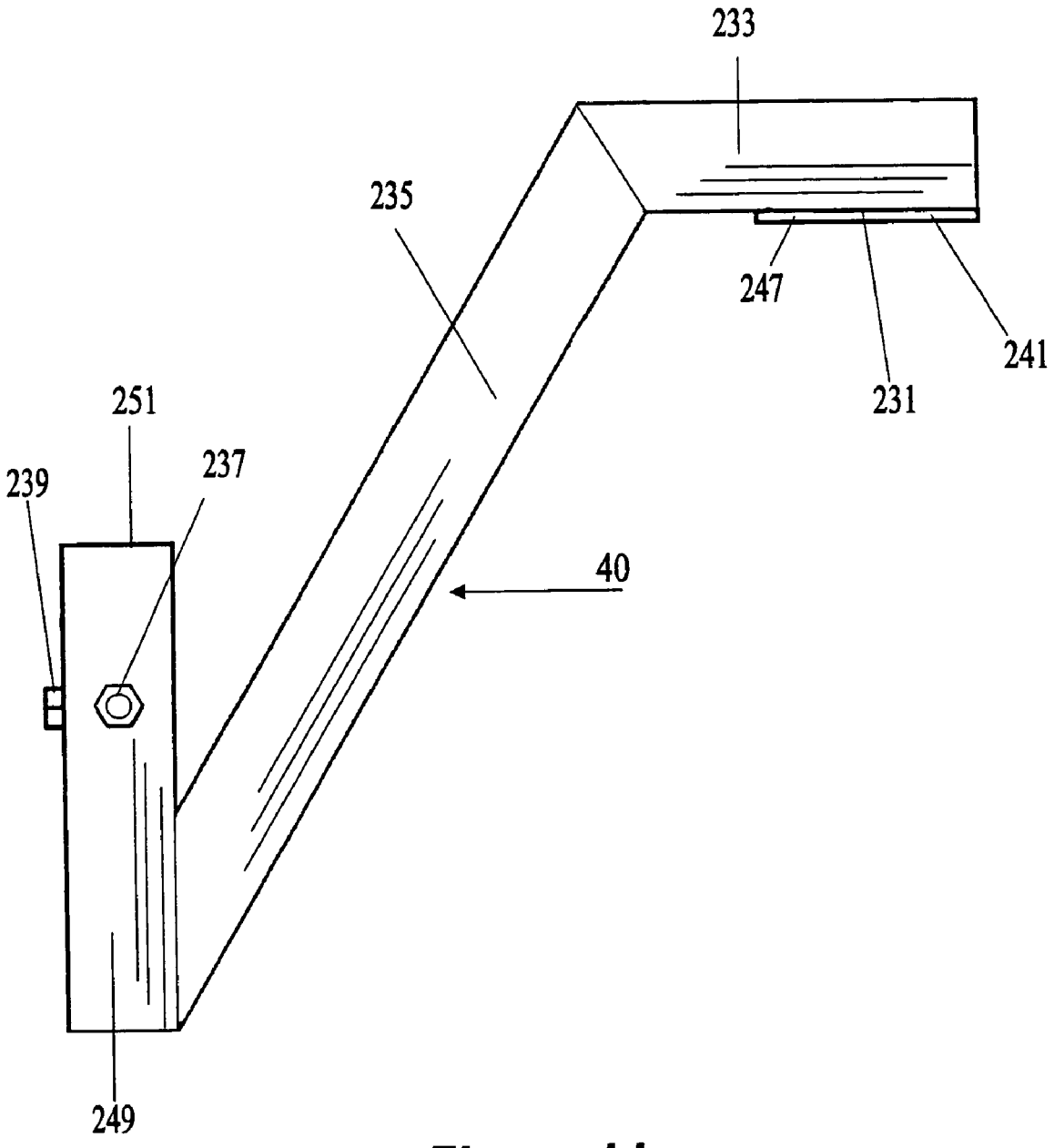
FIG. 11 is a side view of a horizontal surface mounting bracket for the present invention bag dispenser with side panels and guide bar.

Referring now to the drawings wherein like reference numerals designate corresponding parts throughout the several views, FIG. 11 through FIG. 122.

FIG. 11 is a side view of a horizontal surface mounting bracket 40 for the present invention bag dispenser with side panels and guide bar, adapted for mounting on a flat horizontal surface. It includes a flat mounting plate 231 that can be laid on a flat horizontal surface and secured by passing fastening mechanisms through holes 241 and 247. Horizontal mounting frame 233 is connected to the top of flat mounting plate 231 and extends out at a right angle to the edge of flat mounting plate 231. Horizontal mounting frame 233 is adapted to assist in connecting to angled mounting frame 235.

The angled mounting frame 235 is adapted to connect to horizontal mounting frame 233 and extend from horizontal mounting frame 233 at a downward angle. The other end of angled mounting frame 235 is adapted to connect to vertical mounting frame 249.

Vertical mounting frame 249 is connected to extend upwardly from the lower end of angled mounting frame 235 and has opening 251 at its top most end. Opening 251 is adapted to receive the attachment mechanism of the plastic bag dispenser described above. Once the attachment mechanism of the plastic bag dispenser with side panels and guide bar is mounted to the vertical mounting frame 249, the two can be secured together by threading a screw through one of two nuts, 239 and 237, mounted to two adjacent exterior sides of vertical mounting frame 249. The nut 239 or 237 that will be used will depend on the orientation of the plastic bag dispenser with side panels and guide bar with respect to the horizontal surface mounting bracket 40.

Figure 12:
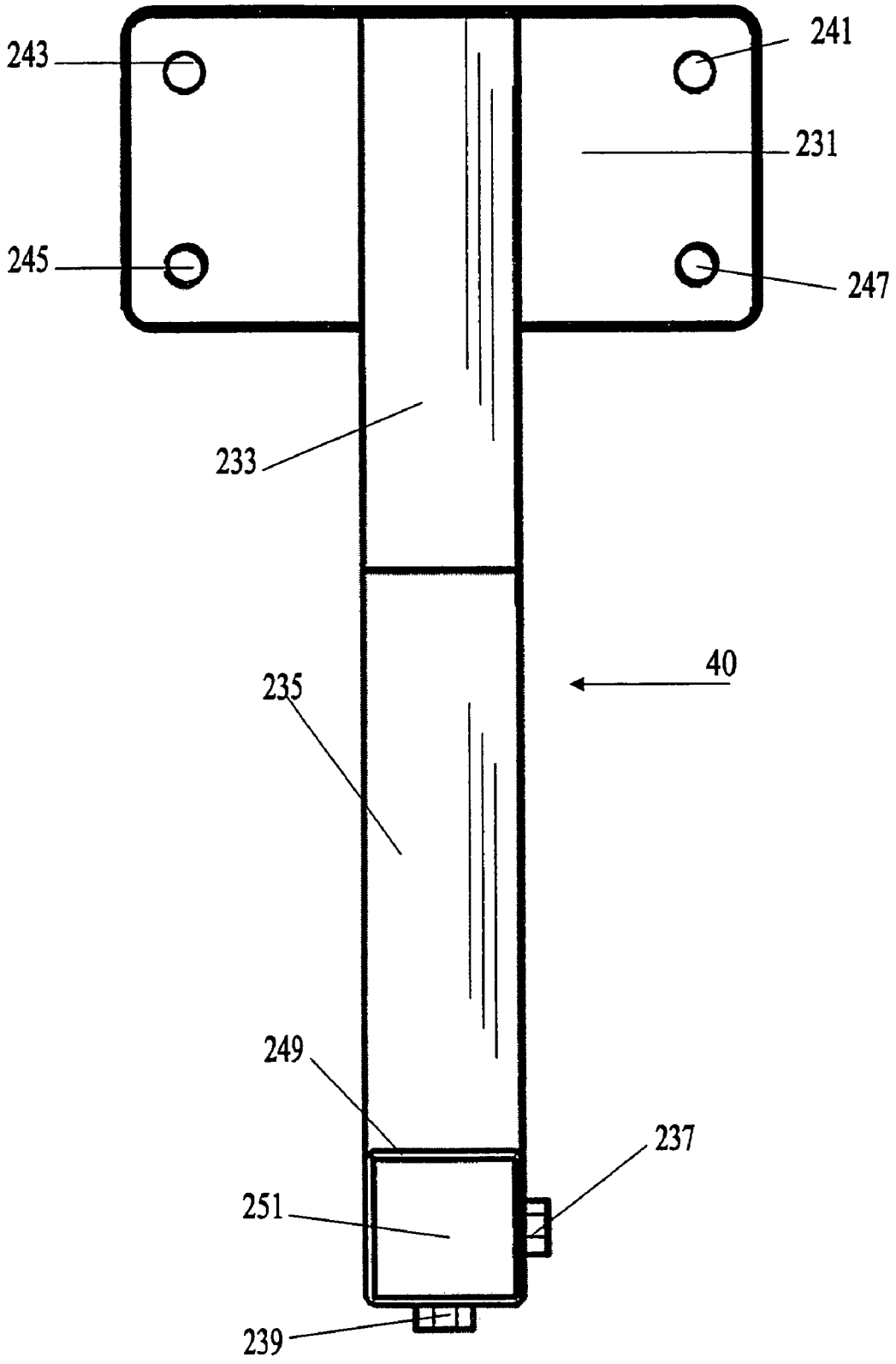
FIG. 12 is a top view of the horizontal surface mounting bracket for the present invention bag dispenser with side panels and guide bar of FIG. 11.

FIG. 12 is a top view of the horizontal surface mounting bracket 40 for the present invention bag dispenser with side panels and guide bar of FIG. 11, better illustrating the flat mounting plate 231. When laid on a flat horizontal surface, flat mounting plate 231 can be secured by passing fastening mechanisms through holes 241, 243, 245 and 247. Horizontal mounting frame 233 is connected to the top of flat mounting plate 231 and extends out at a right angle to the edge of flat mounting plate 231. Horizontal mounting frame 233 is adapted to assist in connecting to angled mounting frame 235.

The angled mounting frame 235 is adapted to connect to horizontal mounting frame 233 and extend from horizontal mounting frame 233 at a downward angle. The other end of angled mounting frame 235 is adapted to connect to vertical mounting frame 249.

Vertical mounting frame 249 is connected to extend upwardly from angled mounting frame 235 and has opening 251 at its top most end. Opening 251 is adapted to receive the attachment mechanism of the plastic bag dispenser described above. Once the attachment mechanism of the plastic bag dispenser is mounted to the vertical mounting frame 249, the two can be secured together by threading a screw through one of two nuts, 239 and 237, located on two adjacent exterior sides of vertical mounting frame 249. The nut 239 or 237 that will be used will depend on the orientation of the plastic bag dispenser with respect to the horizontal surface mounting bracket 40.

Figure 13:
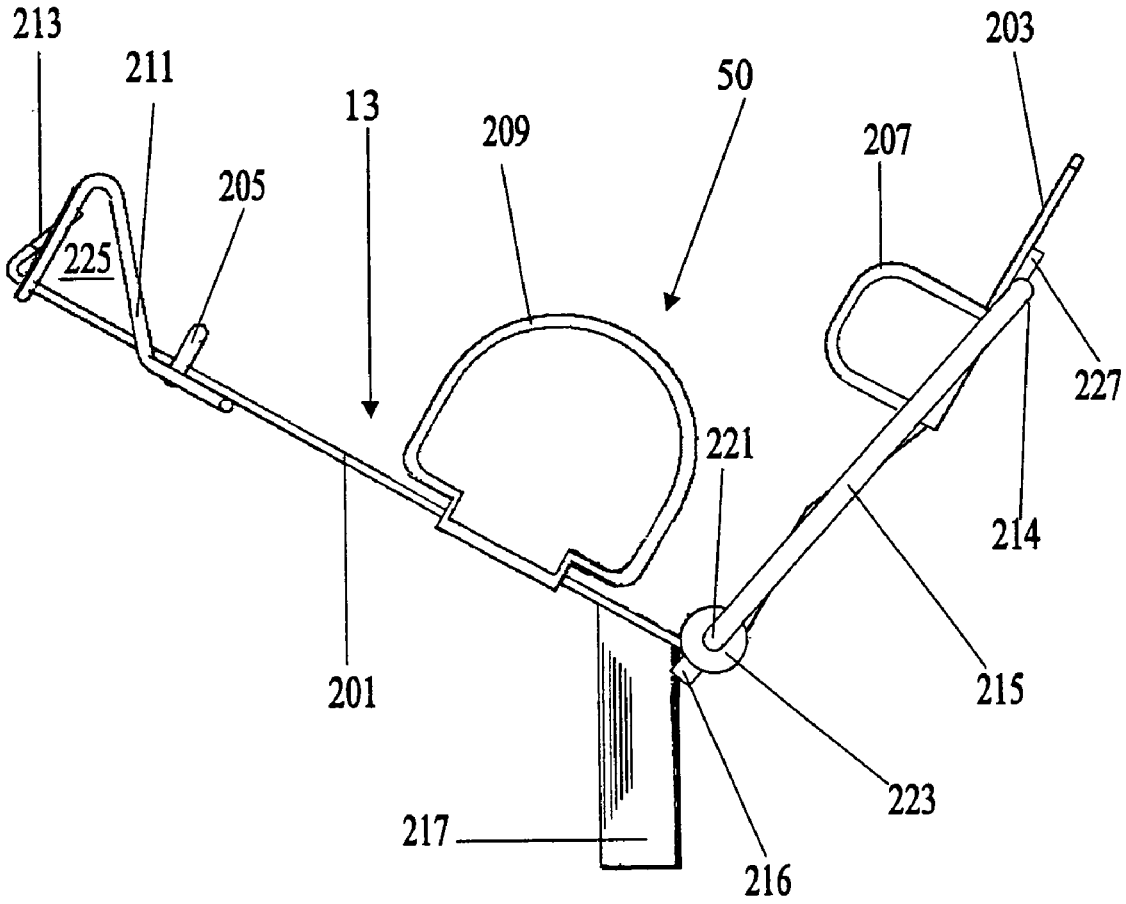
FIG. 13 is a side view of an embodiment of a plastic bag dispenser with side panels and guide bar composed of wire and the swing arm mechanism mounted to the back section of the base frame.

FIG. 13 is a side view of an embodiment of a plastic bag dispenser 50 according to the present invention. The base frame 13 of the plastic bag dispenser 50 is composed of bottom section 201 and back section 203. Bottom section 201 has an open front 225. Attachment means 217 is located to the bottom section 201 and adapted to attach the plastic bag dispenser 50 to a mounting bracket such as a vertical surface mount, a floor stand mount, or a horizontal surface mount, as described below.

A first set of opposing side panels 207 is mounted to back section 203 of the base frame 13 to stabilize the motion of the device during use. A second set of opposing side panels 209 is located on the bottom section 201 of the base frame 13 to stabilize the movement of a nested plastic bag roll. In the present embodiment, wire loops are used to form the first set of opposing side panels 207 and second set of opposing side panels 209. The first set of opposing side panels 207 projects forward at right angles on opposite sides of back section 203. Similarly, the second set of opposing side panels 209 projects at right angles on opposite sides of bottom section 201.

An elongated open guide bar 205 is located toward the open front 225 of the bottom section 201 of the base frame 13. Forward side guard 211 is located near elongated open guide bar 205 on the bottom section 201 of base frame 13. The elongated open guide bar 205 and forward side guard 211 are adapted to maintain proper alignment of the present invention plastic bag dispenser during use. Rip tongue 213 is located on the open front 225 of bottom section 201 of the base frame 13 and has an upward taper adapted to catch and separate.

A swing arm 215 is located on back section 203 of the base frame 13. In the present embodiment of the plastic bag dispenser 50, swing arm 215 and the lower swing arm section 214 generally form an "L" shaped, with a right angle bend where they connect. The swing arm 215 is attached to the bottom section 201 by passing lower swing arm section 214 through swing arm base 227. In the present embodiment of the plastic bag dispenser 50, swing arm base 227 is a mounting bracket with a recess adapted to allow lower swing arm section 214 to act as an axle when couple with swing arm base 227.

Core rod 221 is located at the free end of swing arm 215 such that the lower swing arm section 214, swing arm 215, and core rod 221 generally form a "C" shape. In other embodiments of the present invention, the lower swing arm section 214, swing arm 215, and core rod 221 may take other shapes. Plastic bag roll stop 223 is located on core rod 221. In the present configuration of plastic bag dispenser 50, plastic bag roll stop 223 is a washer, however other designs may be used. The core rod 221 terminates in a bend 216 that is adapted to also assist in maintaining proper alignment and position of the present invention plastic bag dispenser 50 during use.

Figure 14:
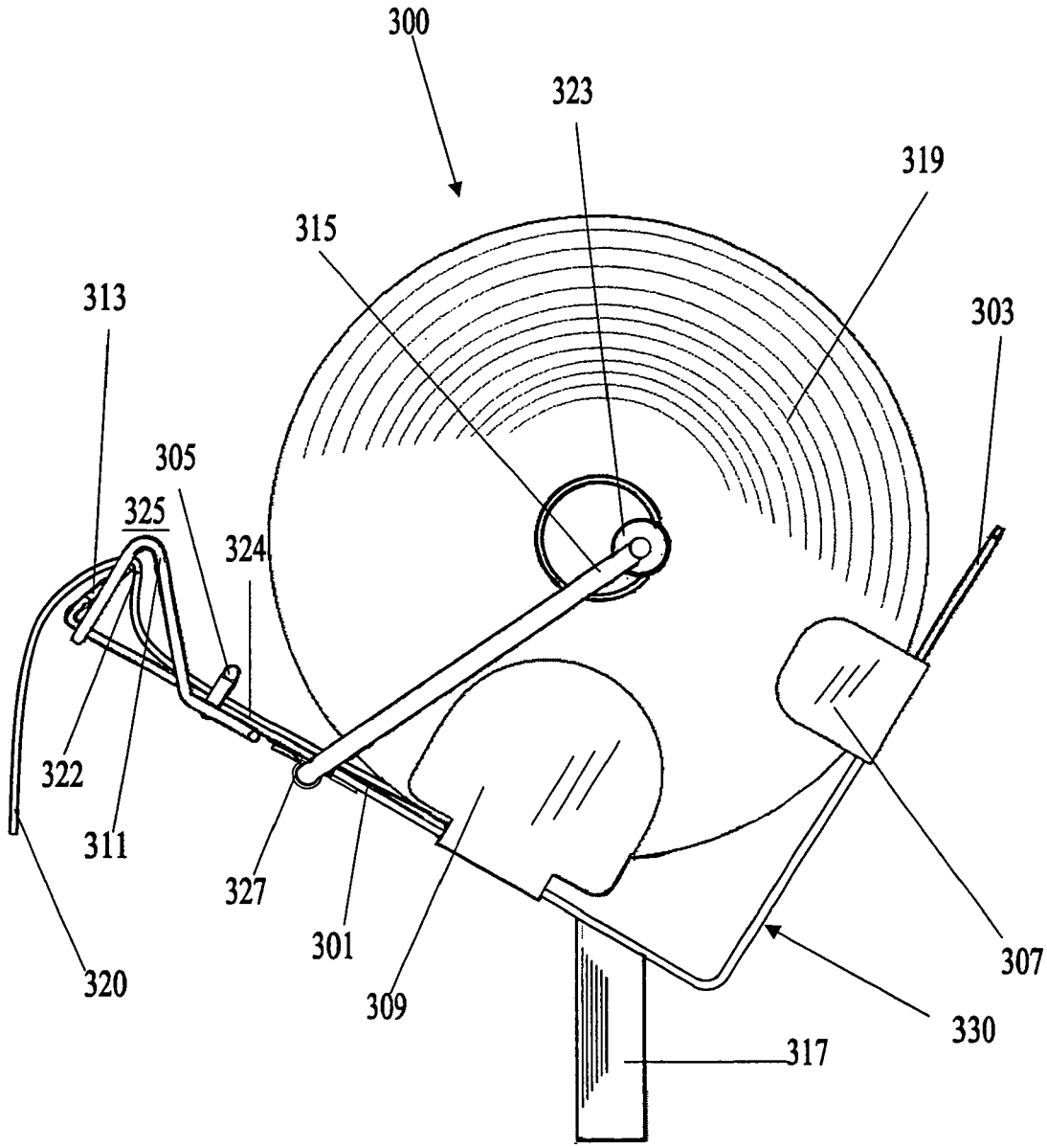
FIG. 14 is a side view of an embodiment of a plastic bag dispenser with side panels and guide bar with a straight back section.

FIG. 14 is a side view of an embodiment of a plastic bag dispenser 300 with a straight back section 303. The base frame 330 of the plastic bag dispenser 300 is composed of bottom section 301 and of back section 303. Bottom section 301 has an open front 325. Attachment means 3 is attached to the bottom section 301 and adapted to attach the plastic bag dispenser 300 to a mounting bracket such as a vertical surface mount, a floor stand mount, or a horizontal surface mount, as described above. Unlike previous embodiments of the present invention, the back section 303 in FIG. 14 is straight to simplify manufacturing.

A first set of opposing side panels 307 is mounted to back section 303 of the base frame 330 to stabilize the movement of a nested plastic bag roll 319. In this embodiment, first set of opposing side panels 307 project forward at a right angle on opposite sides of back section 303. A second set of opposing side panels 309 is located on the bottom section 301 of the base frame 330 to also stabilize the movement of a nested plastic bag roll 319. In this embodiment, second set of opposing side panels 309 project forward at a right angle on opposite sides of bottom section 301.

An elongated open guide bar 305 for movement of plastic bag 320 from the nested plastic bag roll 319 is located toward the open front 325 of the bottom section 301 of the base frame 330. Elongated open guide bar 305 is adapted to assist the movement of plastic bag 320 from the plastic bag roll 319. In the present embodiment, elongated open guide bar 305 is a loop of material located on the bottom section 301 of base frame 330 and oriented perpendicularly therefrom. Forward side guard 311 is located at open front 325 on base section 301 and is tapered to direct the plastic bag 320 over rip tongue 313 as described below.

Rip tongue 313 is located at the open front 325 of bottom section 301 and is transverse to bottom section 301. Rip tongue 313 is adapted to catch and separate a passing bag 320 from a nested plastic bag roll 319.

A swing arm 315 is located along bottom section 301 of the base frame 330. In the present embodiment of the plastic bag dispenser 300, swing arm 315 is generally "L" shaped, with a right angle bend where it extends past the depth of the bottom section 301. The swing arm 315 is attached to the bottom section 301 by swing arm base 327. In the present embodiment of the plastic bag dispenser 300, swing arm base 327 is a mounting bracket with a recess adapted to allow swing arm 315 to act as an axle when couple with swing arm base 327. A plastic bag roll stop 323 is located at the free end of swing arm 315 and is adapted to keep plastic bag roll 319 in place during use. As plastic bag roll 319 is depleted, the swing arm 315 rotates about swing arm base 327 towards bottom section 301 and rear section 303 of base frame 330.

To operate the present invention plastic bag dispenser, a plastic bag 320 is pulled down over the rip tongue 313. Forward side guard 311 has a inward and downward taper (that is, wider at the top and narrower at the bottom) to fine tune bag flow so as to concisely center the plastic bag's 320 perforations 322 with the rip tongue 313 for separation. If an orifice is selected as part of the separation fault, the taper in forward side guard 311 will ensure proper alignment of the separation fault and rip tongue 311. As plastic bag 322 is pulled, nested plastic bag roll 319 unrolls until perforations 322 in plastic bag 320 pass over the rip tongue 313. As the perforations 322 pass over rip tongue 313 the plastic bag 320 separates from the nested plastic bag roll 319. The next plastic bag 324 on the nested plastic bag roll 319 is then positioned in the open front 325 for use. The plastic bag roll 319 is prevented from unraveling when not in use by friction between the plastic bag roll 319 and the bottom section 301 and back section 303 of base frame 330.

Figure 15:
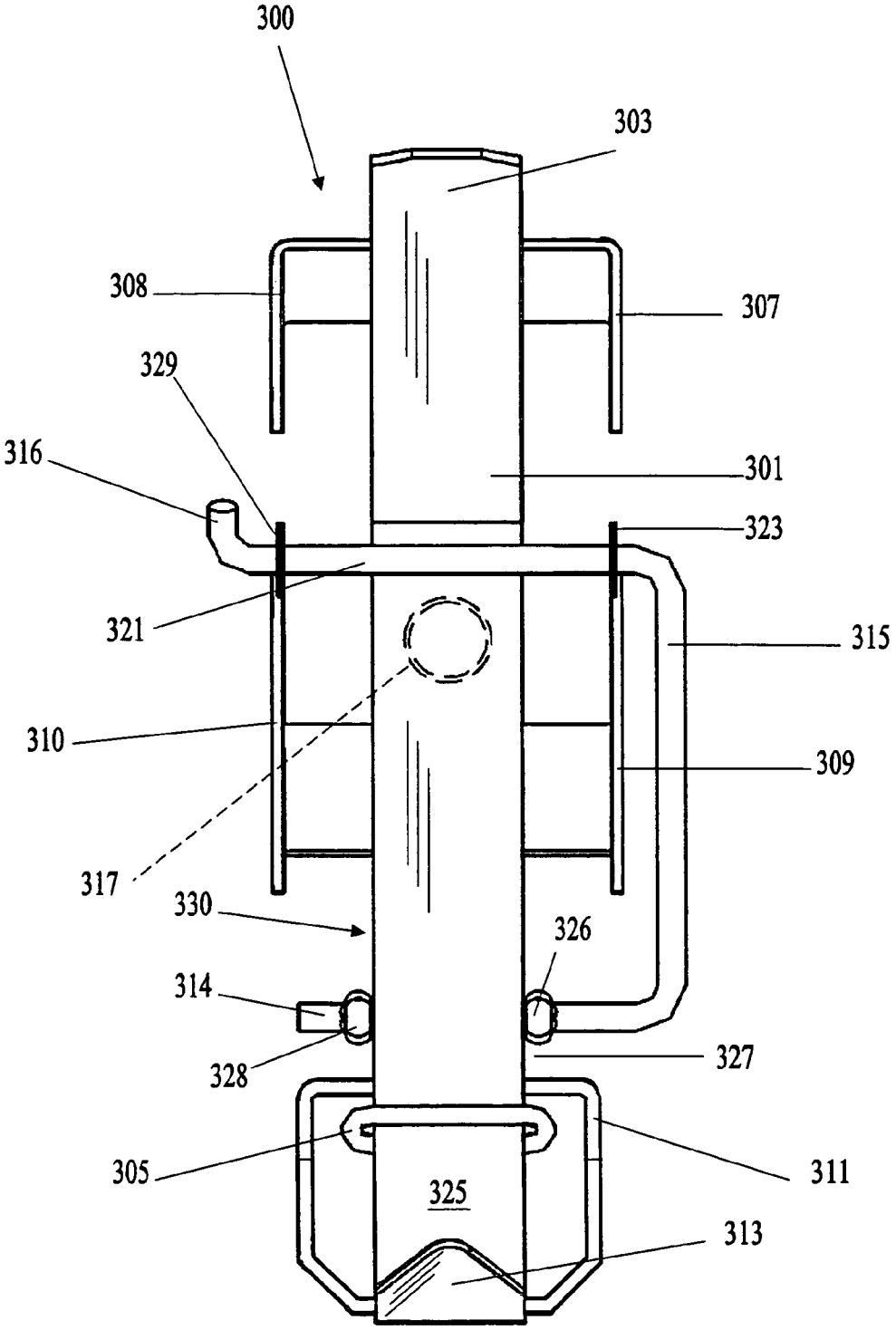
FIG. 15 is a top view of the plastic bag dispenser with side panels and guide bar of FIG. 14 with the plastic bag holding swing arm in an elevated position and a tapered forward side guard.

FIG. 15 is a top view of plastic bag dispenser 300 of FIG. 14 with the plastic bag holding swing arm 315 in an elevated position and a tapered forward side guard 311 better shown. The base frame 330 of the plastic bag dispenser 300 is composed of bottom section 301 and back section 303. Bottom section 301 has an open front 325. Attachment means 317 is mounted to the bottom section 301 and adapted to attach the plastic bag dispenser 300 to a mounting bracket such as a vertical surface mount, a floor stand mount, or a horizontal surface mount, as described above.

A first set of opposing side panels 307 and 308 are located on the back section 303 of the base frame 330. First set of opposing side panels 307 and 308 project forward at right angles on opposite sides of back section 303. A second set of opposing side panels 309 and 310 are located on the bottom section 301 of the base frame 330. Second set of opposing side panels 309 and 310 project forward at right angles on opposite sides of bottom section 301. In the present embodiment of plastic bag dispenser 300, the base frame 330 is generally "L" shaped, with bottom section 301 and back section 303 being straight members.

An elongated open guide bar 305 is located toward the open front 325 of the bottom section 301 of the base frame 330. The elongated open guide bar 305 in the present configuration is a wire loop around the open front 325 of bottom section 301. A forward side guard 311 is located near the elongated open guide bar 305 and attached to the bottom section 301 of base frame 330. The inward taper of forward side guard 311 is readily apparent in FIG. 15. Rip tongue 313 is located on the open front 325 of bottom section 301 of the base frame 330. The rip tongue 313 is designed with an upward taper on the end to improve its functionality during use.

A swing arm 315 is located along bottom section 301 of the base frame 330. In the present embodiment of the plastic bag dispenser 300, swing arm 315 and the lower swing arm section 314 generally form an "L" shaped, with a right angle bend where they connect. The swing arm 315 is attached to the bottom section 301 by passing lower swing arm section 314 through swing arm base 327. Lower swing arm section 314 is kept from sliding out by axel stops 326 and 328, which are compression sleeves attached to lower swing arm section 314 on both sides of mounting bracket 327 in the present embodiment. In the present embodiment of the plastic bag dispenser 300, swing arm base 327 is a mounting bracket with a recess adapted to allow lower swing arm section 314 to act as an axle when couple with swing arm base 327.

Core rod 321 is located at the free end of swing arm 315 such that the lower swing arm section 314, swing arm 315, and core rod 321 generally form a "C" shape. In other embodiments of the present invention, the lower swing arm section 314, swing arm 315, and core rod 321 may take other shapes. Plastic bag roll stops 323 and 329 are located on core rod 321. In the present configuration of plastic bag dispenser 300, plastic bag roll stops 323 and 329 are washers, however other designs may be used. The core rod 321 terminates after plastic bag roll stop 329 in a bend 316 that is adapted to also assist in maintaining proper alignment and position of the present invention plastic bag dispenser 300 during use.

Figure 16:
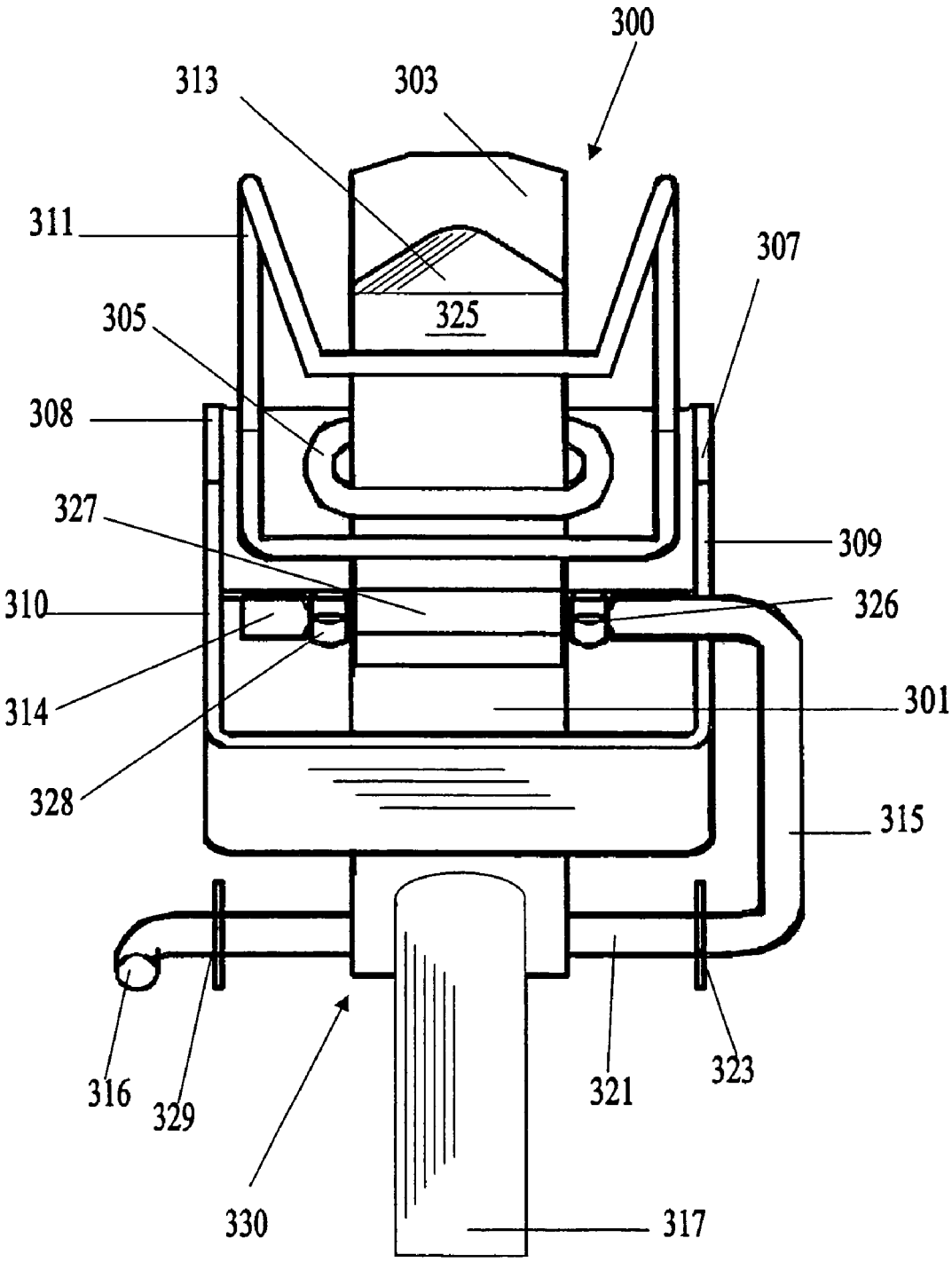
FIG. 16 is a front view of an embodiment of a plastic bag dispenser with side panels and guide bar with the plastic bag holding swing arm resting on the base frame and a tapered forward side guard.

FIG. 16 is a front view of a plastic bag dispenser 300 as described in FIG. 15, better illustrating the vertical spatial arrangement of the components. The base frame 330 of the plastic bag dispenser 300 is composed of bottom section 301 and back section 303. Bottom section 301 has an open front 325. Attachment means 317 is mounted to the bottom section 301 and adapted to attach the plastic bag dispenser 300 to a mounting bracket such as a vertical surface mount, a floor stand mount, or a horizontal surface mount, as described above.

A first set of opposing side panels 307 and 308 are located on the back section 303 of the base frame 330. First set of opposing side panels 307 and 308 project forward at right angles on opposite sides of back section 303. A second set of opposing side panels 309 and 310 are located on the bottom section 301 of the base frame 330. Second set of opposing side panels 309 and 310 project forward at right angles on opposite sides of bottom section 301.

An elongated open guide bar 305 is located toward the open front 325 of the bottom section 301 of the base frame 330. The elongated open guide bar 305 in the present configuration is a wire loop around the open front 325 of bottom section 301. A forward side guard 311 is located near the elongated open guide bar 305 and attached to the bottom section 301 of base frame 330. The downward taper of forward side guard 311 as described above is readily apparent in FIG. 16. Rip tongue 313 is located on the open front 325 of bottom section 301 of the base frame 330. The rip tongue 313 is designed with an upward taper on the end to improve its functionality during use.

A swing arm 315 is located along bottom section 301 of the base frame 330. In the present embodiment of the plastic bag dispenser 300, swing arm 315 and the lower swing arm section 314 generally form an "L" shaped, with a right angle bend where they connect. The swing arm 315 is attached to the bottom section 301 by passing lower swing arm section 314 through swing arm base 327. Lower swing arm section 314 is kept from sliding out by axel stops 326 and 328, which are compression sleeves attached to lower swing arm section 314 on both sides of mounting bracket 327 in the present embodiment. In the present embodiment of the plastic bag dispenser 300, swing arm base 327 is a mounting bracket with a recess adapted to allow lower swing arm section 314 to act as an axle when couple with swing arm base 327.

Core rod 321 is located at the free end of swing arm 315 such that the lower swing arm section 314, swing arm 315, and core rod 321 generally form a "C" shape. In other embodiments of the present invention, the lower swing arm section 314, swing arm 315, and core rod 321 may take other shapes. Plastic bag roll stops 323 and 329 are located on core rod 321. In the present configuration of plastic bag dispenser 300, plastic bag roll stops 323 and 329 are washers, however other designs may be used. The core rod 321 terminates after plastic bag roll stop 329 in a bend 316 that is adapted to also assist in maintaining proper alignment and position of the present invention plastic bag dispenser 300 during use.

To summarize, the present invention thus provides a plastic bag dispenser with side panels and guide bar which comprises a base frame, a plastic bag roll holding mechanism, a first and second set of opposing side panels, and elongated open guide for movement of plastic bags from a nested roll of plastic bags and a rip tongue located on at the bottom section of the base frame. The present invention also provides a mounting means for mounting the plastic bag dispenser with side panels and guide bar to a vertical surface, horizontal surface, or floor.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A plastic bag dispenser with side panels and guide bar, which compromises:

a) a base frame including a back sections and a bottom section, together adapted to receive and nest a plastic bag roll, said bottom section having an open front;

b) a plastic bag roll holding means moveably attached to said base frame, said holding means including a swing arm and a core rod, said core rod adapted to receive a plastic bag roll for rotation therein and adapted to move downwardly via gravity as a plastic bag roll is depleted thereon;

c) a first set of opposing side panels, located on said back section of said base frame for stabilizing the movement of a nested plastic bag roll;

d) a second set of opposing side panels, located on said bottom section of said base frame for stabilizing the movement of a nested plastic bag roll;

e) an elongated open guide bar for movement of bags from a nested roll of plastic bags, said guide bar having at least a top and sides and located toward said open front of said bottom section of said base frame; and, f) a rip tongue located on said open front of said bottom section of said base frame and having an upward taper and adapted to catch and separate a passing bag from a nested plastic bag roll when pulled forward through said guide bar and over said rip tongue.

2. The plastic bag dispenser with side panels and guide bar of claim 1 wherein said rip tongue has a triangular shape.

3. The plastic bag dispenser with side panels and guide bar of claim 1 wherein said base frame is a plate base frame of a material selected from the croup consisting of metal material, plastic material, composite material and combinations thereof.

4. The plastic bag dispenser with side panels and guide bar of claim 1 wherein said guide bar is a wire loop guide bar.

5. The plastic bag dispenser with side panels and guide bar of claim 1 wherein said dispenser further includes:

g) an attachment means attached to said frame for attachment to a support selected from the group consisting of a vertical surface mount, a horizontal surface mount and a post mount.

6. The plastic bag dispenser with side panels and guide bar of claim 5 wherein said attachment means is a tubular member extending away from said base frame for attachment to a support wherein said support is a coinciding tubular support.

7. The plastic bag dispenser with side panels and guide bar of claim 1 wherein said first set of opposing side panels have predetermined size and shape to permit said core rod on said swing arm to move past said first set of opposing side panels.

8. The plastic bag dispenser with side panels and guide bar of claim 1 wherein said second set of opposing side panels have predetermined size and shape to permit said core rod on said swing arm to move over and behind said second set of opposing side panels.

9. The plastic bag dispenser with side panels and guide bar of claim 1 wherein said back section of said base frame includes a friction component against which a plastic bag roll engages to inhibit free opening.

10. The plastic bag dispenser with side panels and guide bar of claim 1 wherein said core rod includes plastic bag roll stops to inhibit lateral movement of a nested plastic bag roll.

11. A plastic bag dispenser with side panels and guide bar, which compromises:

a) a base frame including a back sections and a bottom section, together adapted to receive and nest a plastic bag roll, said bottom section having an open front;

b) a plastic bag roll holding means moveably attached to said base frame, said holding means including a swing arm and a core rod, said core rod adapted to receive a plastic bag roll for rotation therein and adapted to move downwardly via gravity as a plastic bag roll is depleted thereon;

c) a first set of opposing side panels, located on said back section of said base frame for stabilizing the movement of a nested plastic bag roll;

d) a second set of opposing side panels, located on said bottom section of said base frame for stabilizing the movement of a nested plastic bag roll;

e) an elongated open guide bar for movement of bags from a nested roll of plastic bags, said guide bar having at least a top and sides and located toward said open front of said bottom section of said base frame;

f) one set of opposing forward side guards located on said bottom section of said base frame extending upwardly therefrom, said set of opposing forward side guards being located between said second set of opposing side panels and said open front; and, g) a rip tongue located on said open front of said bottom section of said base frame and having an upward taper and adapted to catch and separate a passing bag from a nested plastic bag roll when pulled forward through said guide bar and over said rip tongue.

12. The plastic bag dispenser with side panels and guide bar of claim 11 wherein said rip tongue has a triangular shape and said opposing forward side guards include a taper that is directed inwardly and downwardly.

13. The plastic bag dispenser with side panels and guide bar of claim 11 wherein said base frame is a plate base frame of a material selected from the croup consisting of metal material, plastic material, composite material and combinations thereof.

14. The plastic bag dispenser with side panels and guide bar of claim 11 wherein said guide bar is a wire loop guide bar.

15. The plastic bag dispenser with side panels and guide bar of claim 11 wherein said dispenser further includes:

h) attachment means attached to said frame for attachment to a support selected from the group consisting of a vertical surface, a horizontal surface and a post.

16. The plastic bag dispenser with side panels and guide bar of claim 15 wherein said attachment means is a tubular member extending away from said base frame for attachment to a support wherein said support is a coinciding tubular support.

17. The plastic bag dispenser with side panels and guide bar of claim 11 wherein said first set of opposing side panels have predetermined size and shape to permit said core rod on said swing arm to move past said first set of opposing side panels.

18. The plastic bag dispenser with side panels and guide bar of claim 11 wherein said second set of opposing side panels have predetermined size and shape to permit said core rod on said swing arm to move over and behind said second set of opposing side panels.

19. The plastic bag dispenser with side panels and guide bar of claim 11 wherein said back section of said base frame includes a friction component against which a plastic bag roll engages to inhibit free opening.

20. The plastic bag dispenser with side panels and guide bar of claim 11 wherein said core rod includes plastic bag roll stops to inhibit lateral movement of a nested plastic bag roll.

* * * * *